US009339721B2

(12) United States Patent
Kadile

(10) Patent No.: US 9,339,721 B2
(45) Date of Patent: May 17, 2016

(54) PLAY SET FOR LAUNCHING AN ACTION FIGURINE

(71) Applicant: Mattel, Inc., El Segundo, CA (US)

(72) Inventor: Michael A. Kadile, Redondo Beach, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 14/581,519

(22) Filed: Dec. 23, 2014

(65) Prior Publication Data

US 2015/0140892 A1 May 21, 2015

Related U.S. Application Data

(63) Continuation-in-part of application No. 14/549,710, filed on Nov. 21, 2014.

(60) Provisional application No. 61/907,116, filed on Nov. 21, 2013.

(51) Int. Cl.

| | |
|---|---|
| ***A63H 3/52*** | (2006.01) |
| ***A63H 13/06*** | (2006.01) |
| ***A63C 19/00*** | (2006.01) |

(52) U.S. Cl.

CPC ..... *A63C 19/005* (2013.01); *A63H 3/52* (2013.01); *A63H 13/06* (2013.01)

(58) Field of Classification Search

CPC ..... A63H 3/50; A63H 3/52; A63H 3/20; A63H 13/06; A63H 29/18; A63H 33/18; A63F 9/02; A63F 9/0278; A63F 9/0252; A63C 19/005

See application file for complete search history.

(56) References Cited

U.S. PATENT DOCUMENTS

| | | | |
|---|---|---|---|
| 485,896 | A | 11/1892 | Sterry, Jr. |
| 1,001,395 | A | 8/1911 | Herbery |
| 1,010,549 | A | 12/1911 | Welch |

(Continued)

FOREIGN PATENT DOCUMENTS

| | | |
|---|---|---|
| EP | 0 528 725 | 2/1993 |
| FR | 2 929 131 | 10/2009 |

OTHER PUBLICATIONS

English Abstract Translation for EP 0 528 725.

(Continued)

*Primary Examiner* — Gene Kim
*Assistant Examiner* — Alyssa Hylinski
(74) *Attorney, Agent, or Firm* — Kolisch Hartwell, P.C.

(57) ABSTRACT

A toy ring is disclosed herein. The toy ring having: a platform; a plurality of posts positioned about the platform, a first one of the plurality of posts being pivotally mounted to the platform at a first end and configured for movement between a first position and a second position, wherein a second end of the first one of the plurality of posts, opposite the first end, moves in a first direction away from the platform when the first one of the plurality of posts is moved from the first position to the second position; an elastic member secured to each one of the plurality of posts, wherein the elastic member provides a biasing force to the first one of the plurality of posts in a second direction opposite to the first direction when the launching post is in the second position; and a moveable platform pivotally secured to the platform, wherein the moveable platform moves from a first position to a second position as the first one of the plurality of posts is moved from its first position towards its second position.

20 Claims, 20 Drawing Sheets

(56) References Cited

U.S. PATENT DOCUMENTS

| | | | | | |
|---|---|---|---|---|---|
| 1,015,343 | A | | 1/1912 | Riexinger | |
| 1,040,616 | A | | 10/1912 | Burke | |
| 1,100,356 | A | | 6/1914 | Dade et al. | |
| 1,129,551 | A | | 2/1915 | Collins | |
| 1,167,958 | A | | 1/1916 | Watkins | |
| 1,168,829 | A | | 1/1916 | Sheppard | |
| 1,196,548 | A | | 8/1916 | Keffer | |
| 1,202,748 | A | | 10/1916 | Lowman | |
| 1,207,195 | A | | 12/1916 | Miller | |
| 1,260,205 | A | | 3/1918 | Kelly | |
| 1,264,947 | A | | 5/1918 | Leggett | |
| 1,266,765 | A | | 5/1918 | Boufford | |
| 1,281,798 | A | | 10/1918 | Leggett | |
| 1,281,836 | A | | 10/1918 | Ratchford | |
| 1,295,292 | A | | 2/1919 | Fermier | |
| 1,379,103 | A | | 5/1921 | Jensen | |
| 1,435,326 | A | | 11/1922 | Mullin | |
| 1,442,970 | A | | 1/1923 | Rank | |
| 1,558,537 | A | | 10/1925 | Drake | |
| 1,576,515 | A | | 3/1926 | Kinney | |
| 1,611,155 | A | | 12/1926 | Bisaillon | |
| 1,753,328 | A | | 4/1930 | Barnes | |
| 1,799,735 | A | | 4/1931 | Crowell | |
| 1,811,929 | A | | 6/1931 | Harris | |
| 1,812,930 | A | | 7/1931 | Chester | |
| 1,812,931 | A | | 7/1931 | Chester | |
| 2,119,327 | A | | 5/1938 | Gunnarson | |
| 2,158,052 | A | | 5/1939 | Berger | |
| 2,166,572 | A | | 7/1939 | Staudt | |
| 2,175,604 | A | | 10/1939 | Holmes | |
| 2,204,078 | A | * | 6/1940 | Ferrary | A63F 9/02 273/336 |
| 2,243,943 | A | | 6/1941 | Bunting | |
| 2,267,865 | A | | 12/1941 | Hurley | |
| 2,269,095 | A | | 1/1942 | Davis | |
| 2,389,606 | A | | 11/1945 | Borregard | |
| 2,421,279 | A | | 5/1947 | Marty | |
| 2,431,552 | A | | 11/1947 | Gosnell | |
| 2,453,646 | A | | 11/1948 | Tomlin et al. | |
| 2,455,430 | A | | 12/1948 | Luckhaupt | |
| 2,463,355 | A | | 3/1949 | Buchmann | |
| 2,496,725 | A | * | 2/1950 | Hotcaveg | A63H 13/06 446/335 |
| 2,499,147 | A | * | 2/1950 | Land | A63H 13/06 446/334 |
| 2,531,260 | A | | 11/1950 | Davenport | |
| 2,586,432 | A | | 2/1952 | Land | |
| 2,603,034 | A | | 7/1952 | Whitlock | |
| 2,622,835 | A | * | 12/1952 | Ippolito | A63H 3/50 248/149 |
| 2,726,866 | A | | 12/1955 | Nally | |
| 2,760,306 | A | | 8/1956 | Pelletier | |
| 2,832,174 | A | | 4/1958 | Yip | |
| 3,073,560 | A | | 1/1963 | Montgomery | |
| 3,235,259 | A | * | 2/1966 | Glass | A63H 13/06 273/440.1 |
| 3,409,295 | A | | 11/1968 | Bernstein | |
| 3,672,082 | A | | 6/1972 | Tepper et al. | |
| 3,794,325 | A | | 2/1974 | Stender | |
| 3,856,304 | A | | 12/1974 | Matsumoto et al. | |
| 3,864,870 | A | * | 2/1975 | Breslow | A63H 13/06 446/334 |
| 3,876,197 | A | | 4/1975 | Jenson | |
| 3,927,883 | A | | 12/1975 | Bosley et al. | |
| 3,969,841 | A | | 7/1976 | Joseph | |
| 4,091,563 | A | * | 5/1978 | Noble | A63H 13/06 273/440.1 |
| 4,344,243 | A | | 8/1982 | Reszka | |
| 4,356,658 | A | | 11/1982 | Goldfarb | |
| 4,368,875 | A | | 1/1983 | Weiss et al. | |
| 4,609,195 | A | | 9/1986 | Ham | |
| 4,844,461 | A | | 7/1989 | Namanny et al. | |
| 5,186,119 | A | * | 2/1993 | Hlavin | A63C 19/062 116/201 |
| 5,413,517 | A | | 5/1995 | Kamijima | |
| 5,655,767 | A | | 8/1997 | Francis et al. | |
| 5,727,982 | A | * | 3/1998 | Hurt | A63H 3/20 446/241 |
| 6,220,577 | B1 | | 4/2001 | Ostrow | |
| 6,325,692 | B1 | | 12/2001 | Webb | |
| 6,340,334 | B1 | | 1/2002 | Olsen et al. | |
| 7,007,420 | B2 | | 3/2006 | Garcia | |
| 7,238,127 | B2 | | 7/2007 | Al-Harbi | |
| 7,255,312 | B2 | | 8/2007 | Melic | |
| 7,475,881 | B2 | * | 1/2009 | Blagg | A63F 9/00 273/440.1 |
| 7,510,152 | B2 | | 3/2009 | Melic | |
| 8,137,151 | B2 | * | 3/2012 | Kenney | A63F 3/00028 446/330 |
| 8,808,054 | B1 | * | 8/2014 | Barthold | A63H 33/42 446/309 |
| 2007/0128973 | A1 | * | 6/2007 | Blagg | A63F 9/00 446/334 |
| 2009/0020956 | A1 | | 1/2009 | McCall | |
| 2009/0318056 | A1 | * | 12/2009 | Glover | A63H 13/06 446/383 |
| 2011/0012310 | A1 | | 1/2011 | Anderton et al. | |
| 2012/0208427 | A1 | | 8/2012 | Barthold | |
| 2012/0264347 | A1 | * | 10/2012 | Barthold | A63H 33/42 446/75 |
| 2012/0316002 | A1 | * | 12/2012 | Antuna | A63C 19/005 472/93 |
| 2013/0017895 | A1 | | 1/2013 | Mechling et al. | |
| 2013/0316613 | A1 | | 11/2013 | O'Hare et al. | |
| 2014/0073218 | A1 | | 3/2014 | Barthold | |

OTHER PUBLICATIONS

English Abstract Translation for FR 2 929 131.

United States Patent and Trademark Office, Office Action for U.S. Appl. No. 14/549,710, Sep. 10, 2015, 8 pages.

* cited by examiner

PLAY SET FOR LAUNCHING AN ACTION FIGURINE

CROSS REFERENCE TO RELATED APPLICATIONS

This application is a continuation-in-part of U.S. patent application Ser. No. 14/549,710 filed on Nov. 21, 2014, which claims the benefit of U.S. Provisional Patent Application No. 61/907,116 filed Nov. 21, 2013, the entire contents each of which are incorporated herein by reference thereto.

BACKGROUND

Various embodiments of the present invention are related to a play set or toy ring for use with an action figure or figurine wherein the toy ring or play set is configured to launch the action figure from a component of the play set or toy ring.

Children's toys have included miniature cars, boats, trains, figures, etc. wherein the user's imagination provides for hours of extended play and enjoyment. Toy figures that resemble real life characters are particularly popular as the user can participate in imaginary play that mimics real life activities and/or scenes.

Wrestling and/or boxing events provide fun and entertainment for both children and adults. Toy wrestling and boxing action figures and play pieces allow fans to reenact and create wrestling and boxing matches that resemble real-life wrestling and/or fighting activities.

Accordingly, it is desirable to provide a toy ring or play set that allows for simulated wrestling and/or fighting activities. It is also desirable to provide a toy that presents multiple play scenarios thereby increasing an end user's interaction with the toy, and encouraging imaginative play.

SUMMARY OF THE INVENTION

In one embodiment, a toy ring is provided. The toy ring having: a platform; a plurality of posts positioned about the platform, the plurality of posts including at least one launching post configured for movement between a first position and a second position, wherein movement from the first position to the second position is in a first direction away from the platform; an elastic member secured to each one of the plurality of posts; and a biasing member for providing a biasing force to the launching post in a second direction opposite to the first direction when the launching post is in the second position.

In another embodiment, a toy ring is provided. The toy ring having: a platform; a plurality of posts positioned about the platform, the plurality of posts including at least one launching post pivotally mounted to the platform at a first end and configured for movement between a first position and a second position, wherein a second end of the launching post, opposite the first end, moves in a first direction away from the platform when the launching post is moved from the first position to the second position; and an elastic member secured to each one of the plurality of posts, wherein the elastic member provides a biasing force to the launching post in a second direction opposite to the first direction when the launching post is in the second position.

In yet another embodiment, a toy wrestling ring and an action figure are provided. The toy wrestling ring having: a platform; a plurality of posts positioned about the platform, the plurality of posts including at least one launching post pivotally mounted to the platform at a first end and configured for movement between a first position and a second position, where a second end of the launching post, opposite the first end, moves in a first direction away from the platform when the launching post is moved from the first position to the second position; an elastic member secured to each one of the plurality of posts, wherein the elastic member provides a biasing force to the launching post in a second direction when the launching post is in the second position, the second direction being opposite to the first direction; and an action figurine configured to be removably secured to the second end of the launching post, such that movement of the launching post from the second position to the first position with the action figurine located on the second end of the launching post propels the action figurine into or over an area of the ring surrounded by the plurality of posts and the elastic member.

In yet another embodiment, a toy ring is provided. The toy ring having: a platform; a plurality of posts positioned about the platform, a first one of the plurality of posts being pivotally mounted to the platform at a first end and configured for movement between a first position and a second position, wherein a second end of the first one of the plurality of posts, opposite the first end, moves in a first direction away from the platform when the first one of the plurality of posts is moved from the first position to the second position; an elastic member secured to each one of the plurality of posts, wherein the elastic member provides a biasing force to the first one of the plurality of posts in a second direction opposite to the first direction when the first one of the plurality of posts is in the second position; and a moveable platform pivotally secured to the platform, wherein the moveable platform moves from a first position to a second position as the first one of the plurality of posts is moved from its first position towards its second position.

In still yet another embodiment, a toy play set is provided. The toy play set having: a structure; a post pivotally mounted to the structure at a first end and configured for movement between a first position and a second position with respect to the structure, wherein a second end of the post, opposite the first end, moves in a first direction away from the structure when the post is moved from the first position to the second position; an elastic member secured to the post, wherein the elastic member provides a biasing force to the post in a second direction opposite to the first direction when the post is in the second position; a moveable platform pivotally secured to the structure, wherein the moveable platform is operatively coupled to the post and wherein the movable platform moves from a first position to a second position when the post operatively coupled thereto is moved from its first position towards its second position; and wherein the moveable platform is configured to removably support an action figurine and wherein movement of moveable platform from its first position to its second position moves a first leg of the action figurine towards a second leg of the action figurine when the action figurine is secured thereto and wherein movement of the first leg of the action figurine towards the second leg of the action figurine causes an arm member of the action figurine to move from a first position towards a second position.

In yet another embodiment a toy wrestling ring and at least one action figurine is provided. The toy wrestling ring having: a platform; a plurality of posts positioned about the platform, a first one of the plurality of posts being pivotally mounted to the platform at a first end and configured for movement between a first position and a second position, where a second end of the first one of the plurality of posts, opposite the first end, moves in a first direction away from the platform when the first one of the plurality of posts is moved from the first position to the second position; an elastic member secured to each one of the plurality of posts, wherein the elastic member provides a biasing force to the first one of the plurality of posts in a second direction opposite to the first direction when the first one of the plurality of posts is in the second position; and an action figurine operatively coupled to the first one of the plurality of posts via a movable member pivotally secured to the platform, such that movement of the first one of the plurality of posts between the first position and the second position causes the action figurine to transition from a first position to a second position.

DETAILED DESCRIPTION

In accordance with various embodiments of the present invention a play set or toy ring 10 is provided. The play set or toy ring 10 has a plurality of posts 14, including at least one launching post. The launching post may be movable with respect to the toy ring 10 from a first or upright position (See at least FIGS. 1, 2A, 2B, 3A and 5) to a second or loaded position (See at least FIGS. 2C and 3B).

In some embodiments, the launching post is spring biased into the first position by a biasing member. Accordingly, the launching post is configured to pivot outwardly and away from the play set 10 towards the second position through application of a user-applied force. Once this force is released, the launching post springs back from the second position towards the first position until the post stops at the first position. When the post stops at the first position, an item or action figurine 21 removably secured to a portion of the post is thrown into the ring. Accordingly and when used in combination with a toy wrestling action figure or figurine 21, the launching post can be used to launch the action figure or figurine 21 across or into the play set 10.

Figure 1:
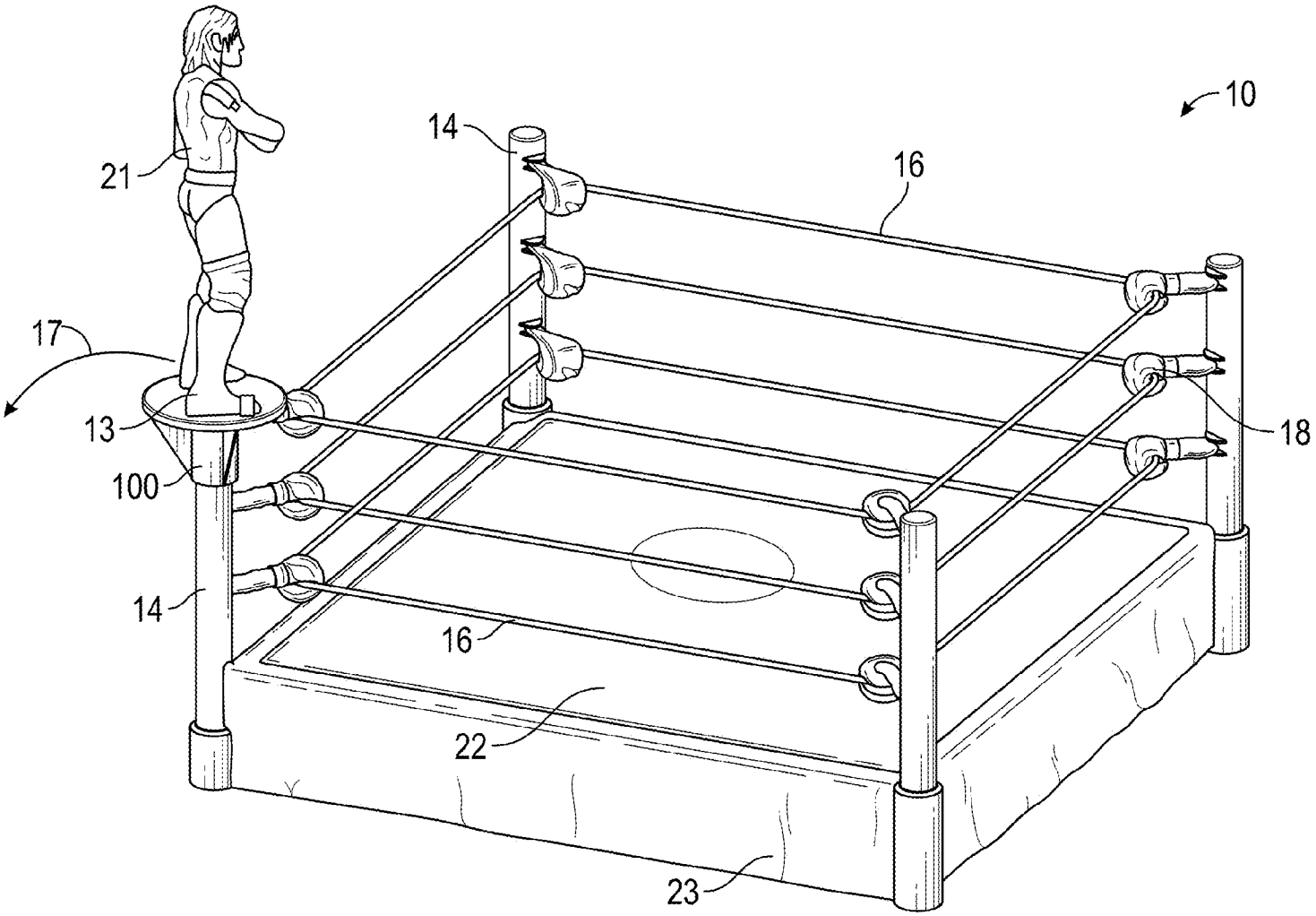
FIG. 1 is a perspective view of a play set or toy ring according to one embodiment of the present invention.

Referring to at least FIG. 1, the play set or toy ring 10 is configured to have four posts 14 located about the perimeter of the play set or toy ring 10. Each post 14 includes a plurality of turnbuckles 18 that are coupled to one or more elastic bands or elastic members that are positioned as elastically expandable ropes 16 that form a perimeter of the play set 10. As mentioned above, at least one post 14 (e.g. the launching post) is selectively movable with respect to the play set and, in some embodiments, may be pivotally or movably mounted to the play set 10 in order to allow for this movement.

As mentioned above, the launching post is spring biased into the first position such that application of a force to the launching post in order to move it towards the second position creates a biasing force towards the first position. Once the force for moving the launching post toward the second position is released, the launching post moves back towards the first position and can be used to launch an action figure or figurine 21 therefrom.

In one non-limiting embodiment, the play set or toy ring 10 is configured to resemble a wrestling or boxing ring having a platform 22. In one embodiment, the platform 22 is supported by a base member 23 which may be integrally formed with the platform 22, or alternatively platform 22 is a separate component attached to the base member 23. As illustrated, the platform 22 is surrounded by a plurality of posts 14 and elastic bands or elastic members or ropes 16 that define a periphery of the ring of the play set 10. In one embodiment, the surface of the platform 22 is elevated from a surface the base member 23 rests upon.

As illustrated, the plurality of posts 14 are positioned about the platform 22 and a plurality of ropes or elastic members 16 are secured to each of the plurality of posts 14. In one embodiment, the elastic bands or elastic members 16 aid in providing the aforementioned biasing force when the launching post is moved into the second position.

In some embodiments, the elastic bands 16 are the only means for providing the biasing force. Although only four posts 14 are illustrated it is of course contemplated for more or less than four posts 14 can be used in various embodiment of the present invention. Also, a plurality of turnbuckles 18 are fixedly connected to each post 14 along the longitudinal length of post 14 wherein each turnbuckle 18 is configured to slidably receive the elastic members 16 therein to allow for the movement of at least one post 14 between its first and second positions.

In other embodiments, one or more posts 14 may be spring biased or spring loaded into the first position by a spring member 60 secured to the post 14. As illustrated, the spring-loaded post 14 is configured to selectively receive an action figure or figurine 21 and correspondingly launch the action figure or figurine 21 therefrom when the post 14 is released from its second position. The spring-loaded post 14 can be configured to launch the action figurine 21 from an action point 80, 100 that is coupled to an end of the post 14. The action point 80, 100 may cooperate with the post 14 to removably retain a portion of an action figure or figurine 21 and launch the action figure or figurine 21 into the play set 10 by moving the post 14 in a first direction from its first position to its second position and releasing the same so that the post 14 springs back towards the first position by travelling in a second direction which is generally opposite to the first direction. At this point the post 14 stops at the first position and thereby launches the action figure or figurine 21 therefrom.

Figure 2A:
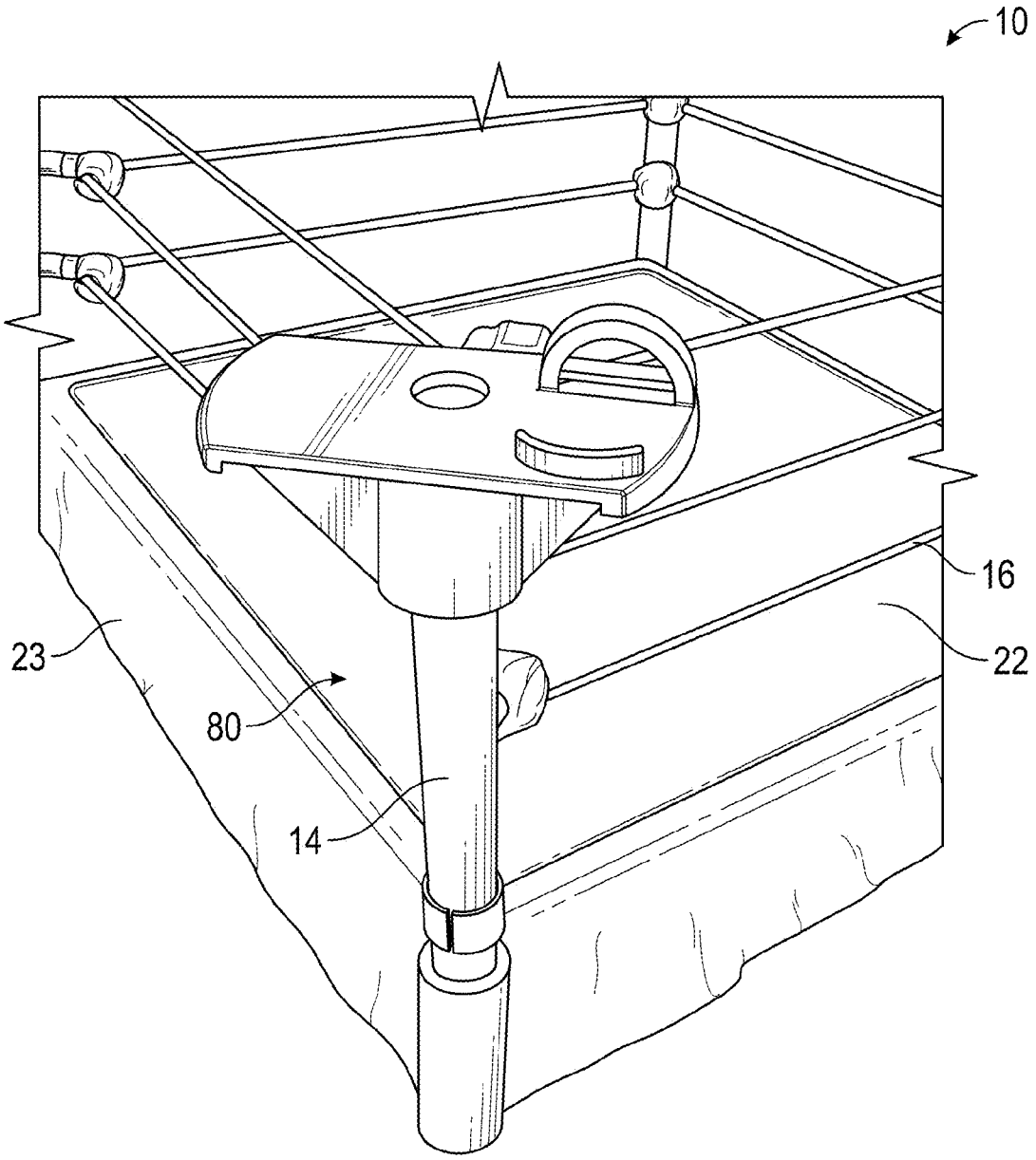
FIG. 2A is a perspective view of the play set or toy ring illustrating at least one spring biased post in a first position.
Figure 2B:
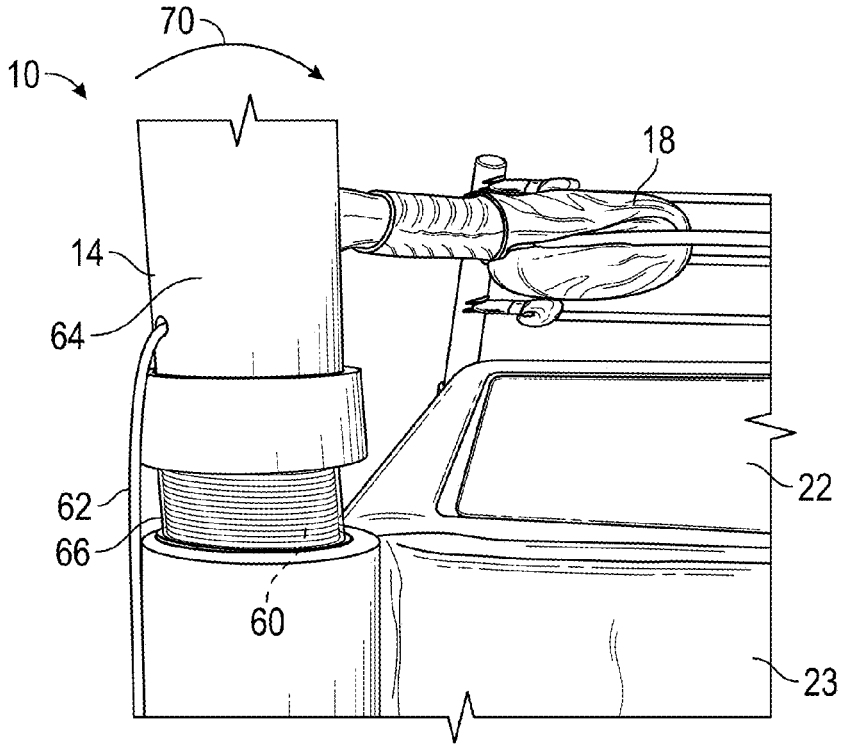
FIG. 2B is a view of a portion of the post illustrated in FIG. 2A.
Figure 2C:
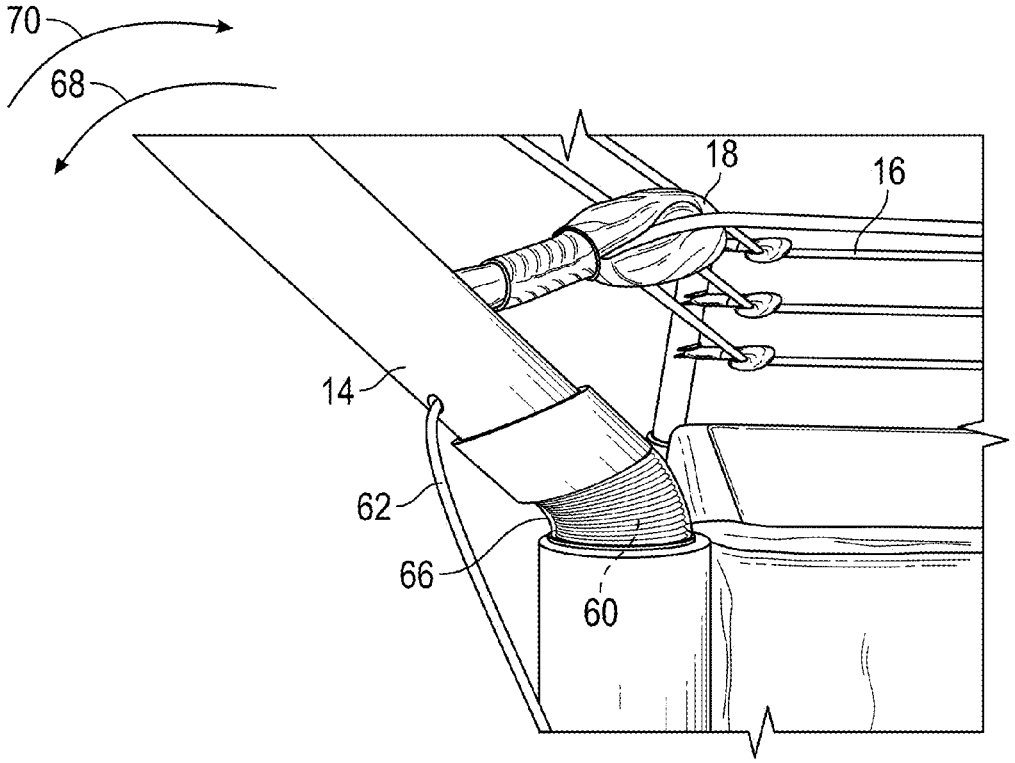
FIG. 2C is a perspective view of the post of FIG. 2A in a second position.

Referring now to FIGS. 2A-2C, one non-limiting embodiment of the play set 10 is illustrated. In this embodiment, the post 14 is secured to the base/platform 23/22 with a spring 60. As illustrated, the spring 60 is located between a bottom portion of the post 14 and a complimentary feature of the base 23. In this embodiment, a stopping member or mechanism 61 such as, for example, a string or elongated member 62 may be provided to prevent over travel of the post 14. The stopping member or mechanism 61 prevents further travel of the post 14 in the second direction once it has reached the first position.

The string or elongated member 62 may be formed from a material that has very little elasticity associated with it such that the string or elongated member 62 does not stretch or elongate once the post 14 reaches its first position after traveling thereto from its second position due to the biasing force of the biasing member(s). In one contemplated embodiment, the string or elongated member 62 is made from a fibrous material with minimal or little stretching capabilities. As such, the stopping member or mechanism 61 prevents the post 14 from extending over platform 22 and/or rebounding out of the "original" or the first position after its return from an extended position or the second position by traveling in the second direction. In other words, the stopping member or mechanism 61 prevents further movement of the post 14 once it has reached its first position after traveling thereto from the second position in the second direction due to the spring biasing force.

As illustrated, the spring 60 couples a lower end 64 of post 14 to the base 23. As the elastic members 16 are stretched due to movement of the post 14 from its first position to its second position, the elastic members 16 may additionally provide a spring biasing force to post 14 as the post 14 is selectively pivoted from its first position to its second position, which is further away from the play set 10.

In one embodiment, a casing 66 may encapsulate the spring 60. The casing 66 may be constructed out of a flexible material to allow for movement of the post 14 as well as spring 60. The casing 66 may aid in preventing a user's fingers from being trapped or pinched by the spring 60 during play when the post 14 is flexed or pivoted outward in the direction of arrow 68 (shown in FIG. 2C). In operation, the post 14 may be configured to be pivoted or flexed from its first position to its second position by, for example, a user grasping and moving the post 14 in the direction of arrow 68 (shown in FIG. 2C).

In its spring-loaded position, the post 14 is at an angle to the first position (shown in FIG. 2C). Upon releasing the post 14 from this position, the spring 60 quickly compresses back to its original position and causes the post 14 to "spring back" in the direction of arrow 70 (shown in FIGS. 2B-2C) towards the platform 22 of play set 10 such that the post 14 returns to its first position. The string 62 restrains the post 14 from oscillating or moving back and forth substantially beyond the first position after post 14 is released from its spring-loaded position or second position. Particularly, the string 62 minimizes or dampens the oscillations from the spring 60 and thus provides a relatively hard stop of the post 14 at its first position after release from its second position.

Figure 3A:
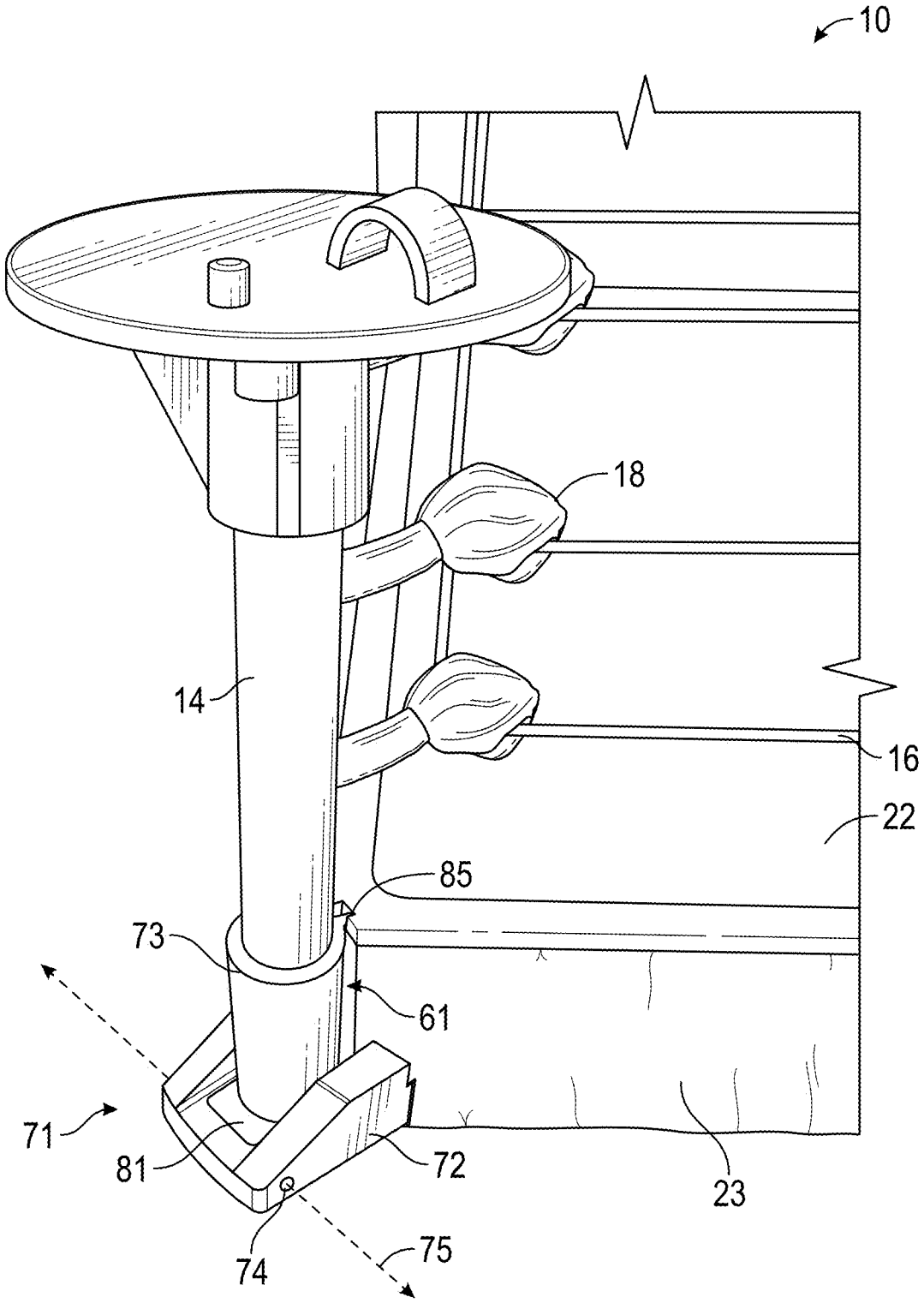
FIG. 3A is a perspective view of a play set or toy ring according to another embodiment illustrating at least one spring biased post in a first position.
Figure 3B:
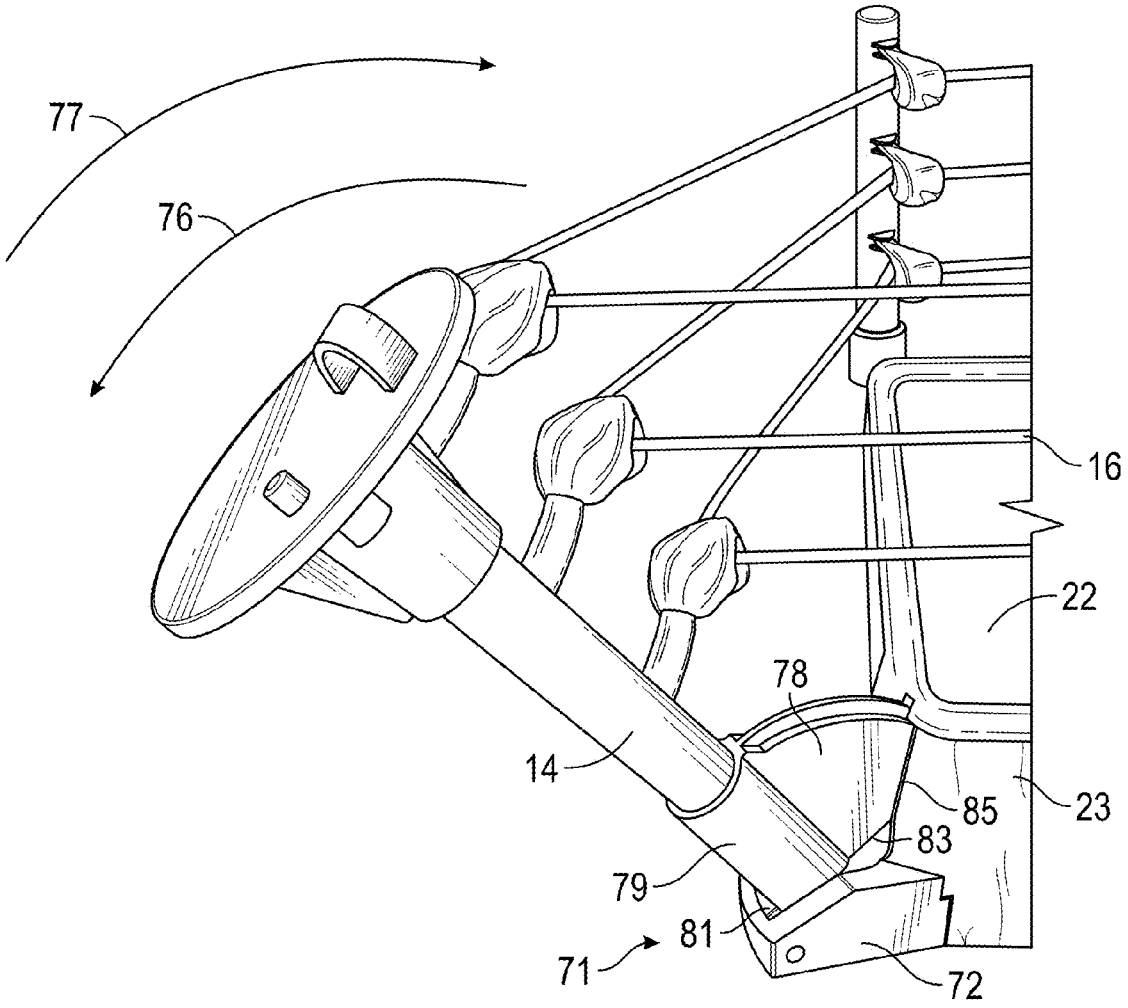
FIG. 3B a perspective view illustrating the post of FIG. 3A moved into a second position.

Referring now to FIGS. 3A-3B and in another non-limiting embodiment, play set 10 includes at least one post 14 that is hingedly or pivotally connected to the base 23 with a hinge assembly 71. The play set 10 also includes one or more ropes or elastic members 16 that are coupled to the post 14 through one or more turnbuckles 18. In the illustrated embodiment, the post 14 is configured to be pivoted from an original position or first position where post 14 is generally orthogonal to a plane of the platform 22 in a first direction to a pivoted position or second position where the post 14 is at an angle from the original position (shown in FIG. 3B). The pivoting may be accomplished by application of a force to the post 14 such as, for example, a user grasping and moving the post 14 in the direction of arrow 76, which corresponds to the first direction. Moving the post 14 in direction of arrow 76 applies an expansive force to the elastic members 16. The elastic members or ropes 16 under the application of this force are elastically loaded when the post 14 is in the second position. Upon releasing the post 14 by the user, the post 14 quickly springs back in the second direction or in the direction of arrow 77 towards platform 22. This is caused by a force applied to the post 14 by the elastically deformed ropes or elastic members 16 when the post 14 is moved into the second position. In some embodiments, the play set 10 includes a stopping mechanism that restrains the post 14 from oscillating or moving back and forth substantially beyond the original first position after being released from its elastically-loaded position or second position.

Also illustrated is that the hinge assembly 71 includes a stationary base 72 and a movable member 73. The stationary base 72 is connected to the base 23 and is configured to receive the movable member 73 therein. In the illustrated embodiment, the stationary base 72 is connected to a vertex or corner of the base 23. The movable member 73 is generally tubular and is coupled to the stationary base 72 with a hinge pin 74 that is aligned on an axis 75. The post 14 is coupled to the movable member 73 along a longitudinal axis of the movable member 73. When a force is applied to the post 14 in the direction of arrow 76, the post 14 pivots away from play set 10 along with movable member 73 about axis 75 of the hinge pin 74. When the force in the direction of arrow 76 is released from being applied to the post 14, the post 14 and the movable member 73 pivots back towards the play set 10 about axis 75 of the hinge pin 74 in the direction of arrow 77.

Also illustrated in FIGS. 3A-3B is that stationary base 72 includes an opening 81 that is configured to receive the movable member 73. In the illustrated embodiment, the movable member 73 is molded as a single piece and includes a generally triangular or pie shaped wedge member or guiding member 78 (FIG. 3B) that extends from a generally cylindrical portion 79. The cylindrical portion 79 is configured to pivot about axis 75 and receive a portion of the post 14 therein. In an alternative embodiment, the post 14 may be integrally formed with cylindrical portion 79. The wedge member 78 is configured to be movably received within a cavity or slotted opening 85 in base 23. The wedge member 78 and opening 85 are configured such that when the post 14 is in the first position, the wedge member 78 is completely or a substantially portion of the wedge member 78 (for example, greater than 75%) is received within opening 85. Of course, other percentages greater or less than 75% are considered to be with the scope of various embodiments of the present invention. When the post 14 is moved to the second position, a portion of the wedge member 78 extends out of opening 85 while another portion remains in opening 85 thus, wedge member 78 guides the travel of the post 14 and also prevents a user's fingers from being caught between the cylindrical portion 79 and the base 23. In one embodiment, the cylindrical portion 79 extends all the way up to at least the platform 22 or a top edge of the base 23 and a top of the wedge member 78 also extends upwardly to at least the platform 22 or the top edge of the base 23 in order to prevent a user's fingers from being caught between the cylindrical portion 79 and the base 23.

Upon releasing the post 14 from the second position, the elastic members 16 compress by releasing energy stored therein and cause the post 14 to quickly spring back in direction of arrow 77 (shown in FIGS. 3B-3C) towards the first position with respect to the platform 22 of play set 10. The wedge member 78 is generally obscured from view under the platform 22 in this position. The wedge member 78 is configured to prevent a user from having their finger or fingers pinched between the post 14 and/or the cylindrical portion 79 and the base 23 when the post 14 is released from the second position and moves back towards the first position.

In some embodiments, the play set 10 and in particular the play set 10 illustrated in FIGS. 3A and 3B may include a stopping member or mechanism 61 to dampen or minimize oscillations in the post 14 once it moves back to the first position. The stopping member or mechanism 61 may be the cylindrical portion 79 which is larger than opening 85 the wedge member 78 travels in. Accordingly and when the post 14 is in the first position, the cylindrical portion 79 contacts the base 23 proximate to the opening 85 and thus limits the travel of the post 14 in the second direction once it has reached the first position. Wedge member 78 also acts as a guide to direct the path of travel of the post 14 in the second direction. The stopping member or mechanism 61 may also be provided by a bottom surface 83 of the wedge member 78 that contacts the base 72 or any other equivalent structure or surface when the post 14 is in the first position and is spaced from the base 72 or any other equivalent structure or surface when the post 14 is in the second position. Accordingly and when the post 14 moves from the second position to the first position, the bottom surface 83 contacts the base 72 and stops its movement in the direction of arrow 77 in order to launch figurine 21 therefrom as well as prevent oscillatory movement of the post 14 back and forth after it is released from the second position. It is understood that the stopping member or mechanism 61 may be solely provided by bottom surface 83 or in an alternative embodiment may be in combination with cylindrical portion 79. In addition and in yet another alternative embodiment, the stopping mechanism 61 may be solely provided by cylindrical portion 79.

Figure 4A:
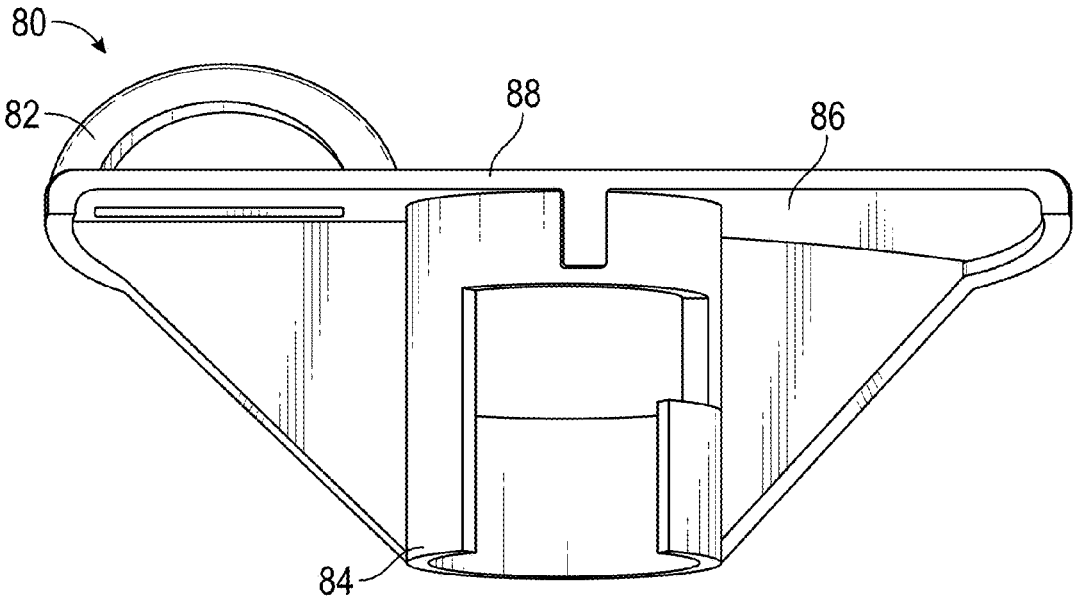
FIG. 4A is a side view of an action point or component of the play set configured for use with a post of the play set.
Figure 4B:
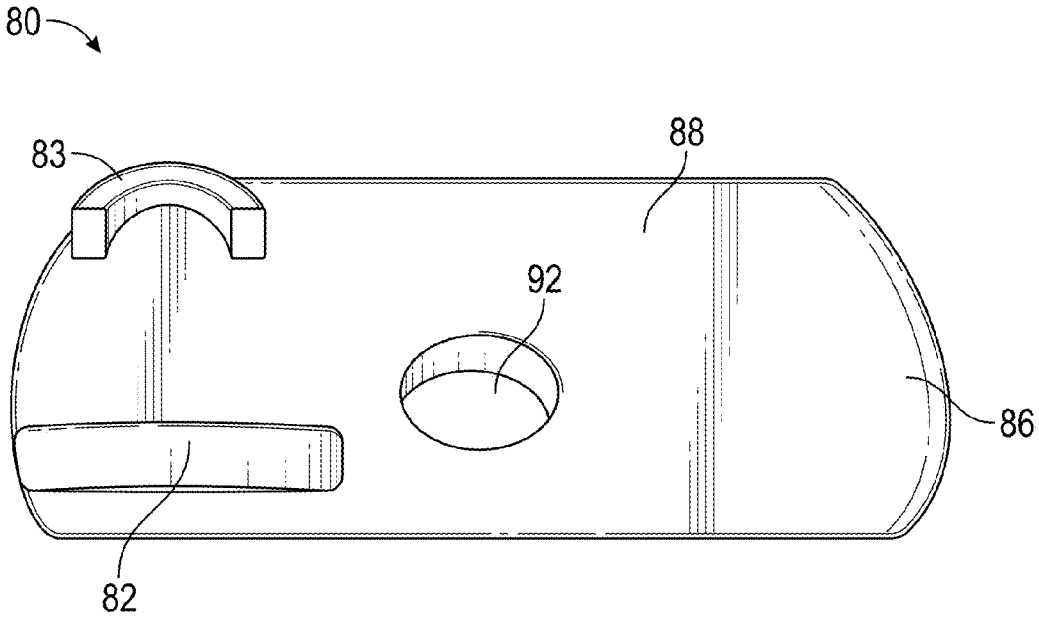
FIG. 4B is a top view of the action point or component illustrated in FIG. 4A.
Figure 4C:
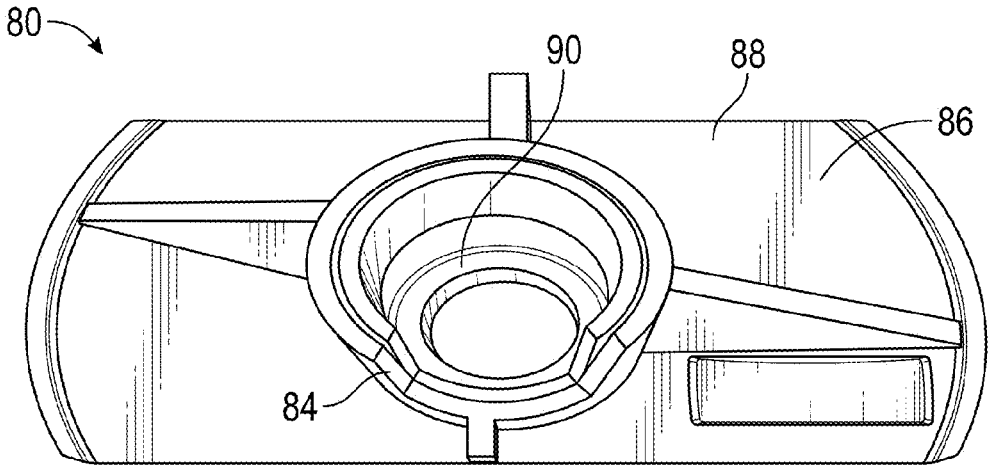
FIG. 4C is a bottom view of the action point or component illustrated in FIG. 4A.

Referring now to FIGS. 4A-4C and in one embodiment, the action point 80 for the play set 10 is illustrated. As illustrated, the action point 80 is configured to have a plurality of engagement features 82, 83 and a retaining member 84. The engagement features 82, 83 are configured to retain and subsequently release a portion of an action figure or figurine 21 while the retaining member 84 is configured to removably engage at least one of the plurality of posts 14 above the plurality of ropes 16.

As shown in FIGS. 4A-4C and in one non-limiting embodiment, the action point 80 is molded as a single piece and includes a rigid body 86 and a generally planar platform 88 that is generally orthogonal to the retaining member 84. In some embodiments, the retaining member 84 is generally aligned at a mid-point of the platform 88. But, in other embodiments, the retaining member 84 may be coupled at a non-midpoint to the platform 88. The retaining member 84 includes a through-opening or bore 90. Additionally, the platform 88 includes a second through-opening 92 that is aligned along the same axis as bore 90 in order to form a continuous opening through body 86. In operation, the action point 80 is configured to removably engage at least one of the plurality of posts 14 through the retaining member 84. The retaining member 84 may allow for the placement of the action point 80 on any of the plurality of posts 14 and in some embodiments, in at least two orientations, for example, two orientations 180 degrees offset from each other. It is also understood that multiple orientations of the action point 80, 100 in various degrees greater or less than 180 degrees as well as various configurations of the action point 80, 100 are considered to be within the scope of various embodiments of the prevent invention.

Also shown in FIGS. 4A-4C is that the platform 88 includes a plurality of engagement features 82, 83. Engagement feature 82 is generally semi-circular in shape and includes an opening that is configured to receive a portion of an action figure or figurine 21 such as, for example, a forefoot area of the action figure or figurine 21. Engagement feature 83 is also semi-circular in shape but is oriented in order to receive another portion of the action figure or figurine 21 such as, for example, a hind foot (e.g., a heel area) of the action figure or figurine 21. In various embodiments, the action point 80 is configured to engage and release a portion of an action figurine 21 that is disposed in one of the plurality of engagement features 82, 83. Although only one action figurine 21 is discussed and shown in the attached figures, it is, of course, understood that numerous action figurines 21 are contemplated to be used with various embodiments of the invention. For example, suitable action figurines 21 may be those available from the MATTEL FLEXFORCE® line of products. Similarly, the action point 80 can be configured to have numerous configurations and arrangements wherein the number of engagement features can be increased or decreased as well as changing the configuration of the same.

Figure 5:
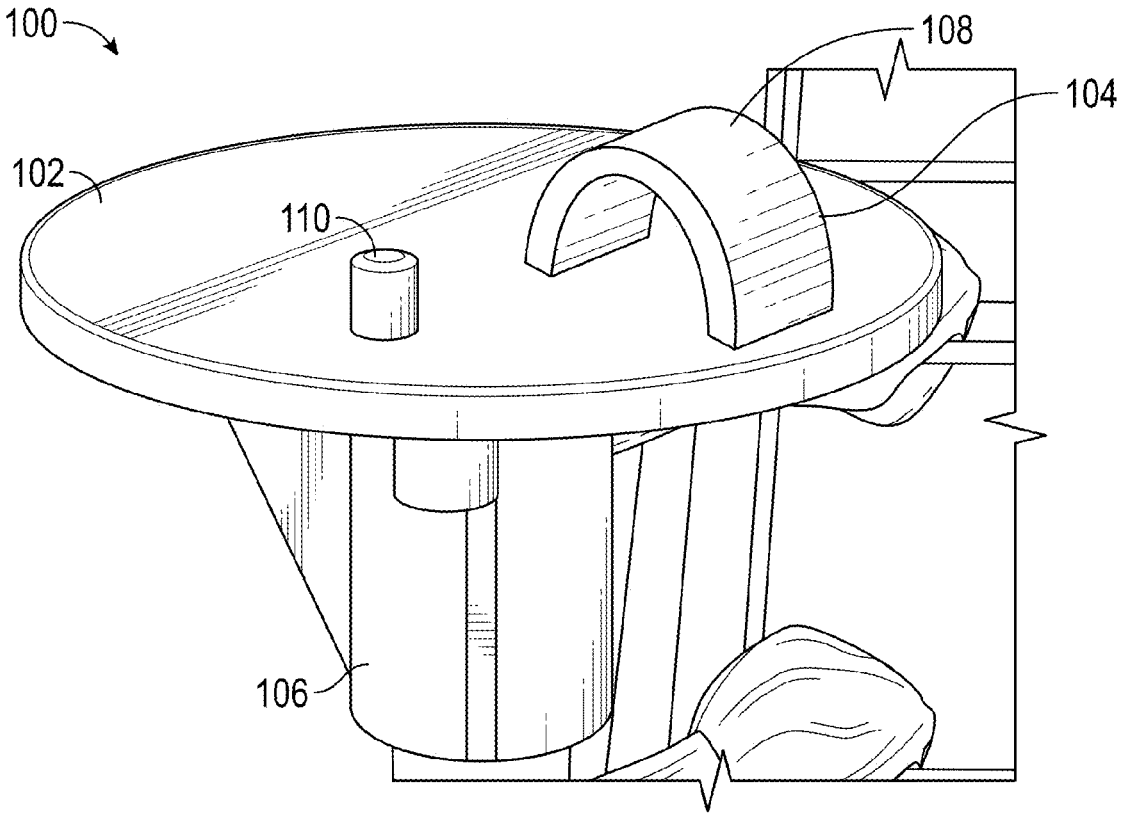
FIG. 5 is a side perspective view of the action point or component according to another embodiment secured to the post of the toy ring.
Figure 6B:
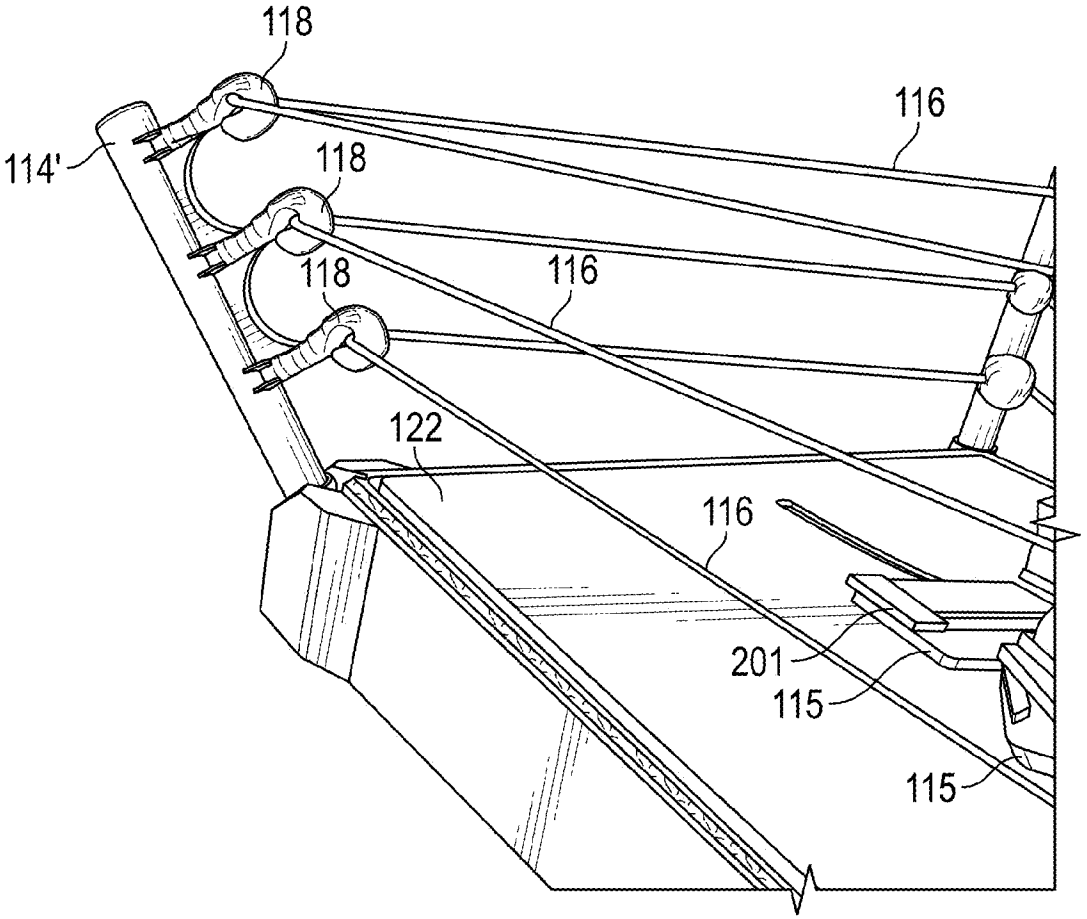
FIG. 6B is a view of a toy according to another embodiment of the present invention in a second position.
Figure 6A:
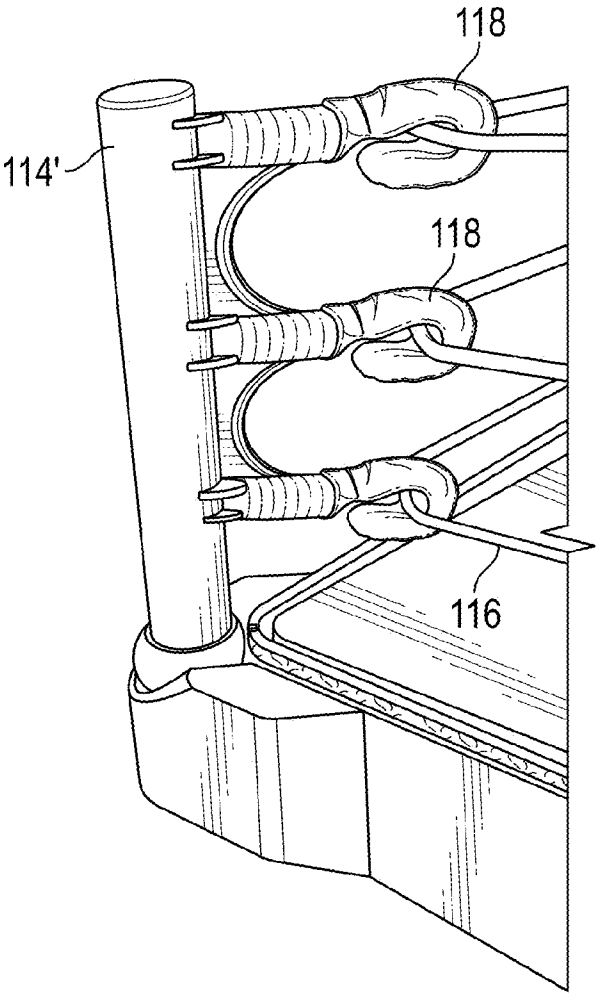
FIG. 6A is a view of a toy according to another embodiment of the present invention in a first position.
Figure 7B:
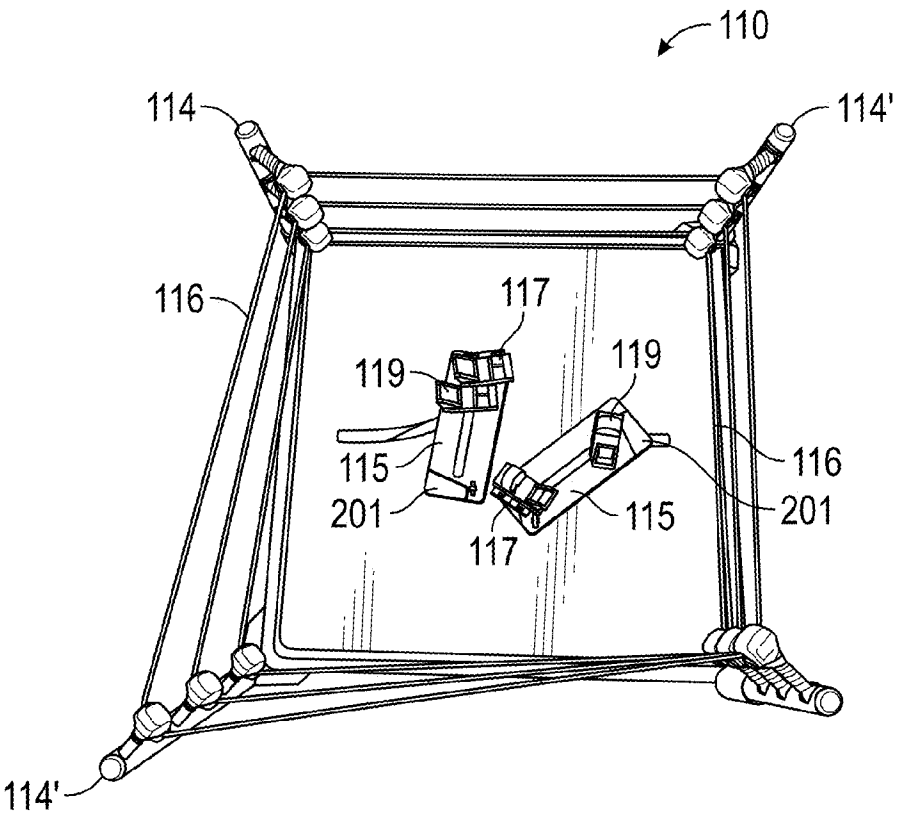
FIG. 7B is a top view of the toy of FIG. 6B in the second position.
Figure 7A:
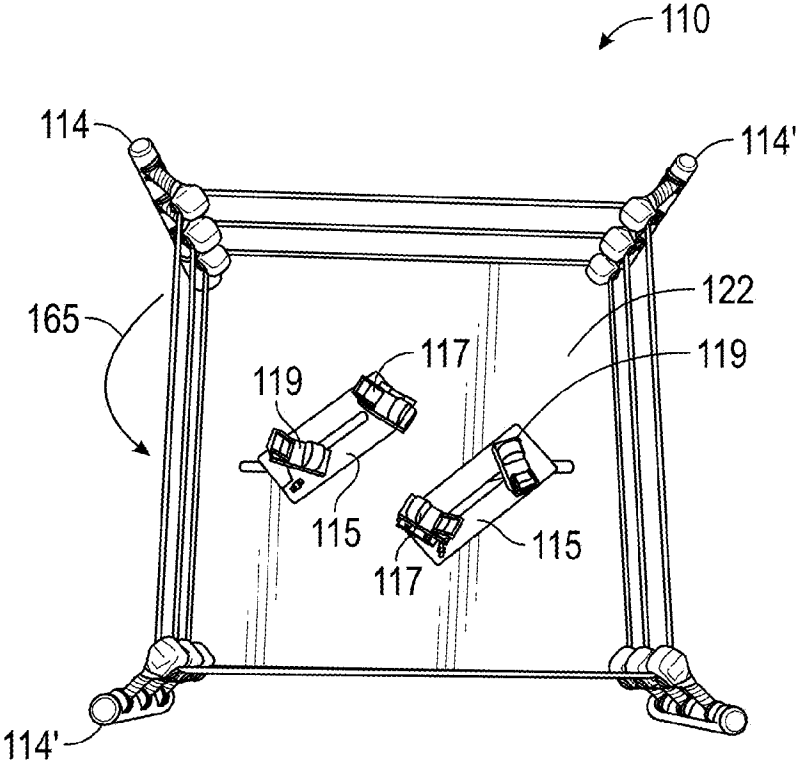
FIG. 7A is a top view of the toy of FIG. 6A in the first position.
Figure 8A:
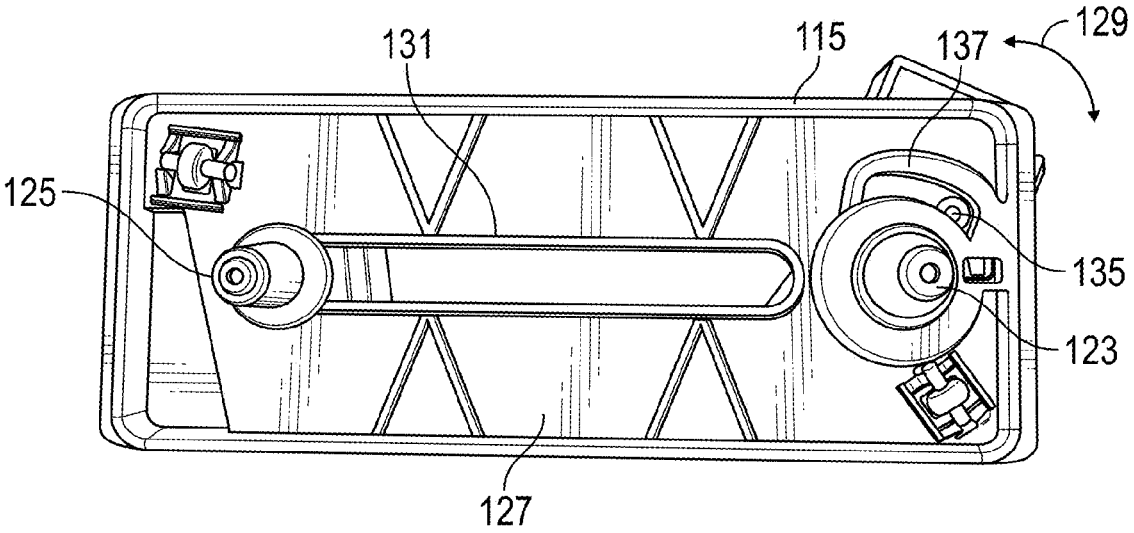
FIG. 8A is a bottom view of a moveable platform according to an embodiment of the present invention.
Figure 8B:
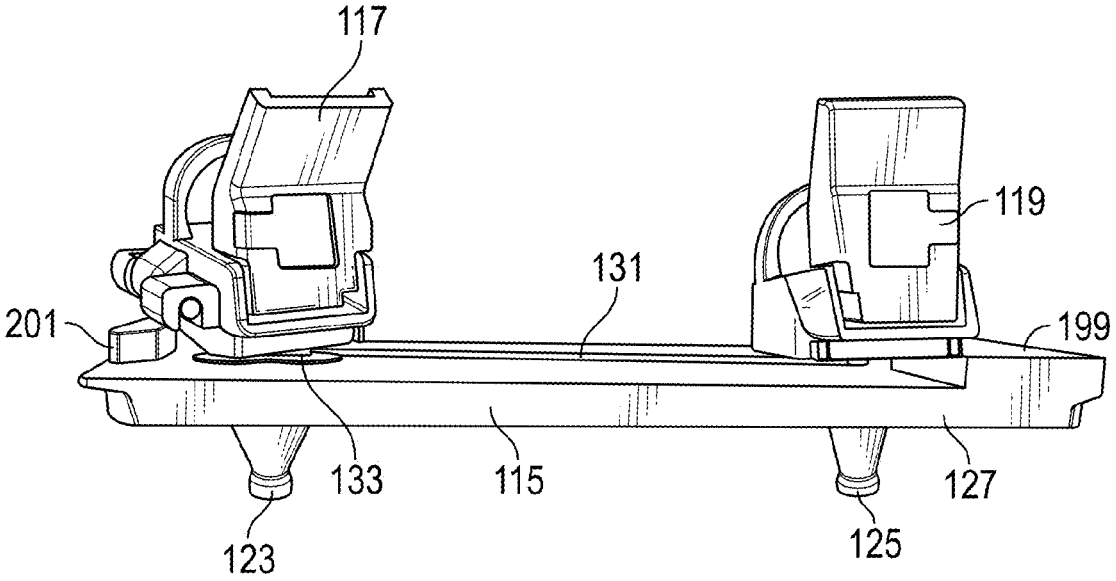
FIG. 8B is a side view of the moveable platform illustrated in FIG. 8A.
Figure 8C:
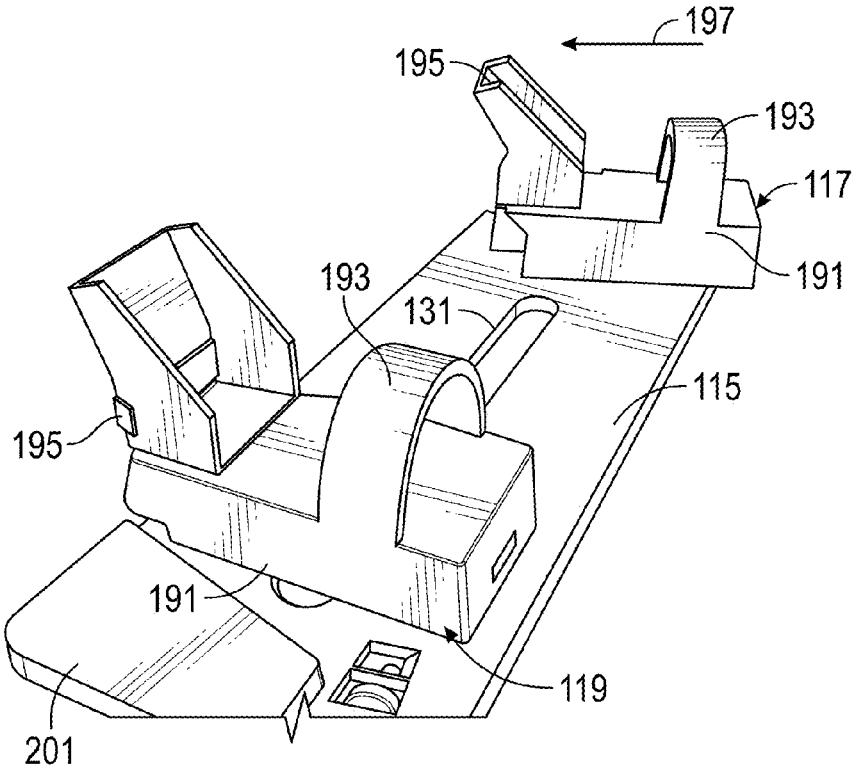
FIGS. 8C and 8D are perspective views of the moveable platform.
Figure 8D:
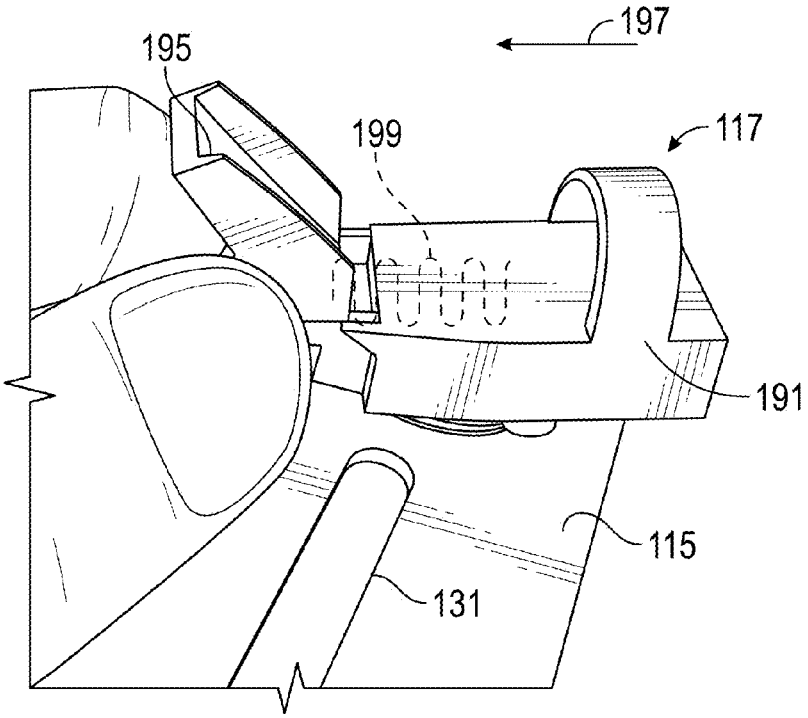
Figure 8E:
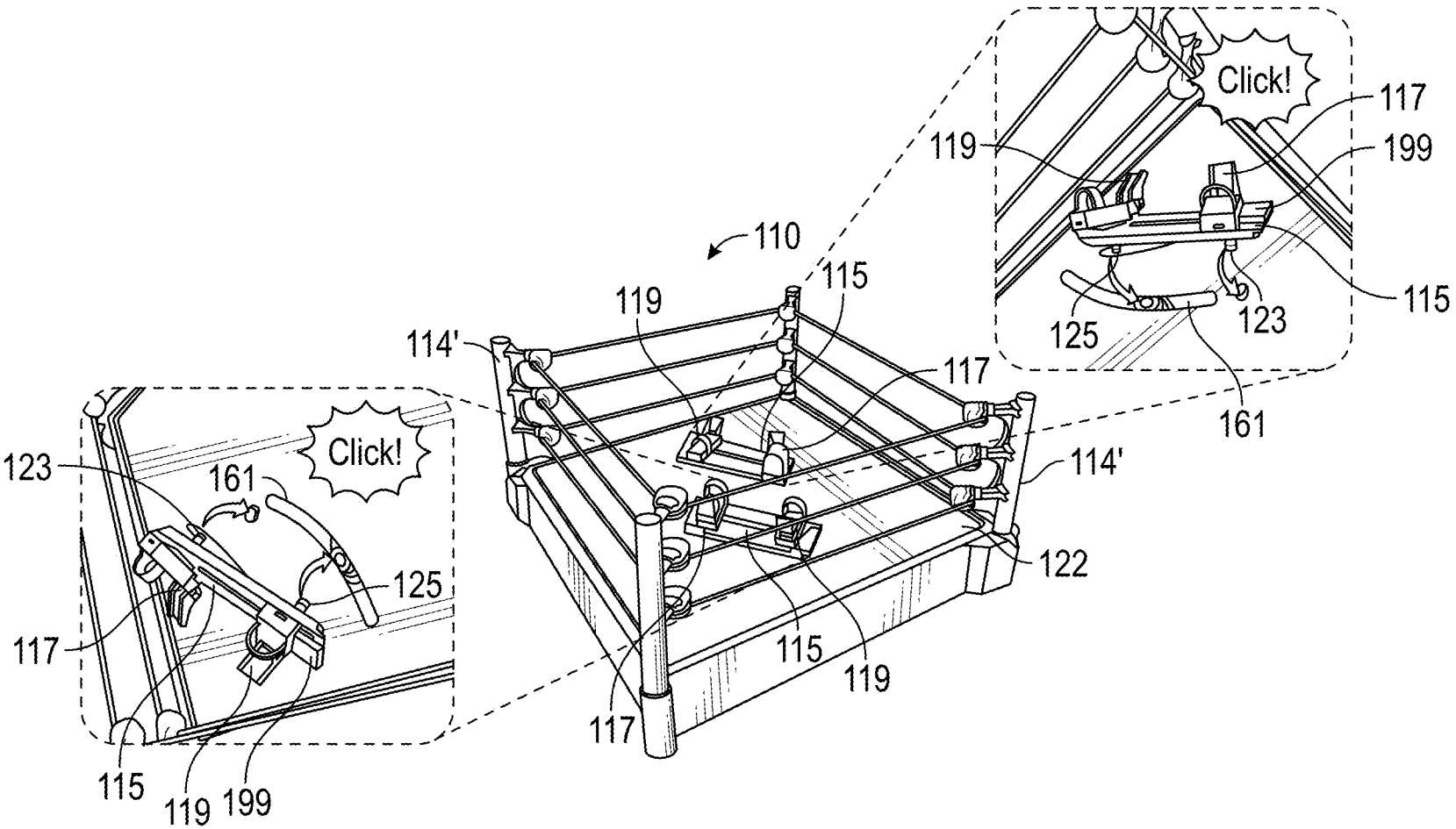
FIG. 8E illustrates securement of the movable platforms to the toy.
Figure 9B:
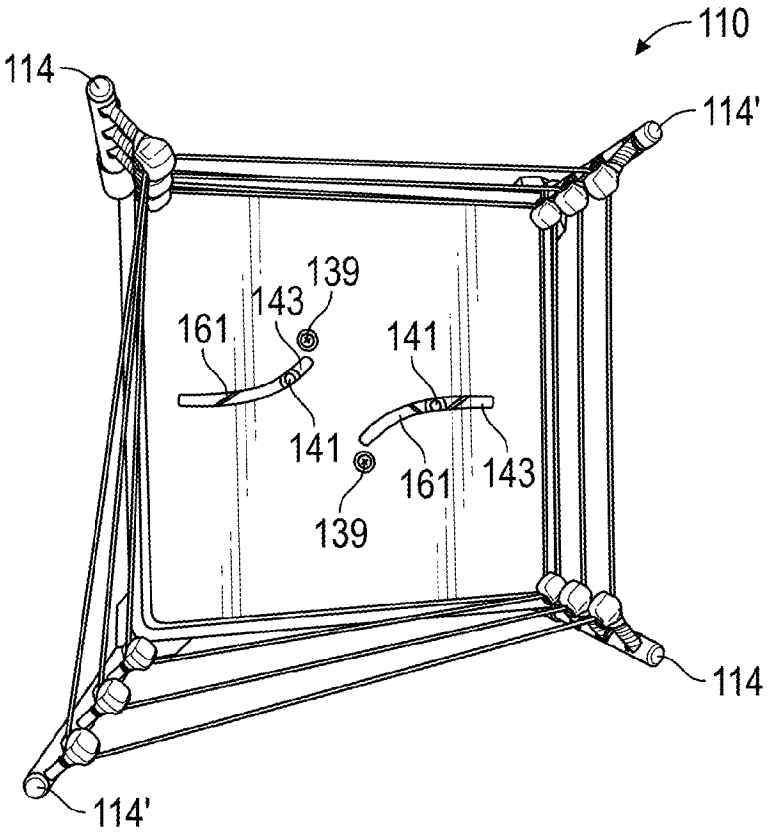
FIG. 9B is a top view of the toy of FIG. 6B in the second position with the moveable platform removed.
Figure 9A:
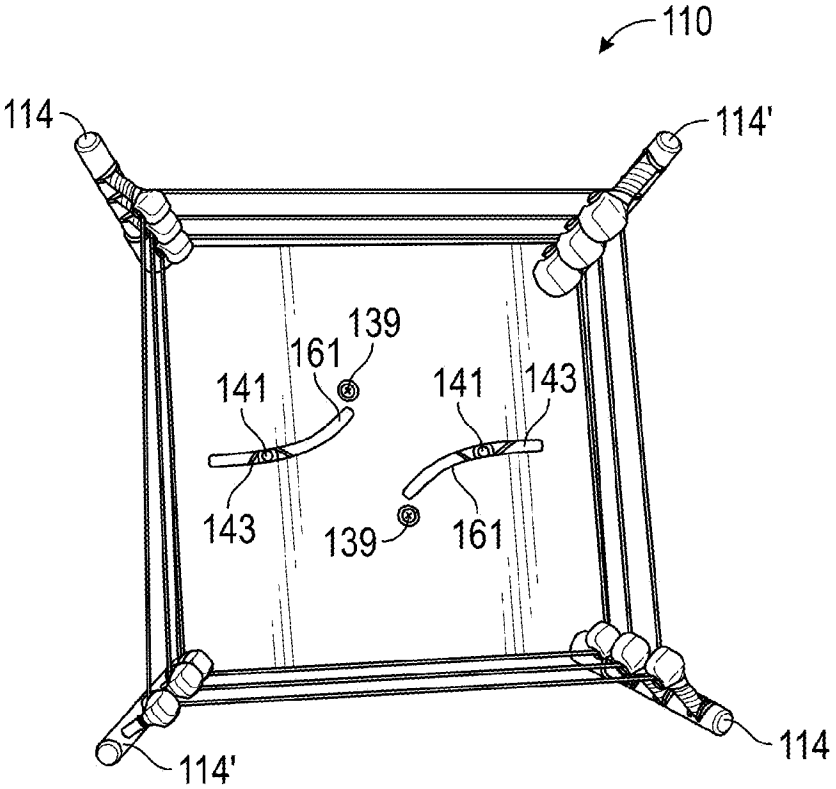
FIG. 9A is a top view of the toy of FIG. 6A in the first position with the moveable platform removed.

In another embodiment and as illustrated in FIG. 5, the action point 100 is molded as a single piece and includes a generally circular planar platform 102. Action point 100 includes a rigid body 104 and a generally planar platform 102 that is orthogonal to a retaining member 106. In operation, the action point 100 is configured to removably engage at least one of the plurality of posts 14 through the retaining member 106. The retaining member 106 allows for the placement of the action point 100 on any one of the plurality of posts and in one embodiment, in at least two orientations 180 degrees offset from each other. It is to be appreciated that multiple orientations and configurations are within exemplary embodiments of the invention.

Also shown in FIG. 5, the platform 100 includes a plurality of engagement features 108, 110. The engagement feature 108 is generally semi-circular in shape and includes an opening that is configured to receive a portion of an action figure or figurine 21 such as, for example, a forefoot area of the foot of the action figure or figurine 21. Engagement feature 110 is generally cylindrical in shape and is configured to be inserted into a complimentary opening in a distal bottom portion of the foot of the action figure or figurine 21 such as, for example, a hind foot area.

In operation and referring initially to FIG. 1, action figure or figurine 21 is shown engaging an action point 100. It is to be appreciated that action point 100 may be used for discussion purposes. But, in other embodiments, action point 80 may also be used in lieu of action point 100 in order to launch the action figurine or figure or figurine 21 with play set 10. In this embodiment, the portion of the action figure or figurine 21 engaging the action point 100 is a single foot 13 configured to be received within the engagement features 108, 110. In order to generate a force to launch the action figurine 21 from the action point 100 after the foot 13 is engaged by the engagement features, a force is applied to the post 14 (FIG. 1) in the direction of arrow 17 by for example, a user's hand wherein the post 14 moves or pivots in the direction of arrow 17 (See also FIG. 2C or 3B). In this position, the spring 60 (FIG. 2B) and/or the elastic members 16 (FIG. 3B) are expanded thereby storing or generating a launching force in a direction opposite to arrow 17.

Once a user's hand is removed, the force in the direction opposite to arrow 17 is released and the post 14 moves in the direction opposite to arrow 17 by a compressive force applied by the spring 60 (FIG. 2B) and/or the elastic ropes or elastic members 16 (FIG. 3B) and the action figure or figurine 21 moves from the second position towards the platform 22. In so doing, the post 14 stops at the first position and the action figure or figurine 21 will launch from the action point 100 towards the platform 22 of the play set or toy ring 10.

In an alternative method of operation, the action figure or figurine 21 may be placed with its back side against the post 14. In some embodiments, the back side may be placed against one or more turnbuckles 18 on the post 14. A user then pulls or pivots the post 14 from its first position to its second position, and, upon releasing the post 14 from its second position, the stored energy in the spring 60 and/or the ropes 16 may be transferred to the action figure or figurine 21 to send the action figurine 21 flying into or across the platform 22 and perhaps crashing into a different toy or accessory.

Referring now to FIGS. 6A-14B an alternative embodiment of the present invention is illustrated wherein components performing similar or analogous functions are labeled in multiples of 100. Here a play set or toy ring 110 is provided. The play set or toy ring 110 has a plurality of posts 114, including at least one launching post or first post 114'. The launching post or first post 114' may be movable with respect to the toy ring 110 from a first or upright position (See at least FIG. 6A) to a second or loaded position (See at least FIG. 6B).

As in the previous embodiments, the launching post 114' is spring biased into the first position by a biasing member, which in one embodiment is the plurality of elastic members 116 secured to each one of the plurality of posts 114. As in the previous embodiments, the plurality of elastic members 116 may be secured to turnbuckles 118. Each launching post 114' is pivotally secured to the toy ring 110 such that it can pivot outwardly and away from the play set 110 towards the second position through application of a user-applied force.

In this embodiment, the play set or toy ring 110 further comprises a moveable platform or platforms 115 movably secured to a surface, structure or platform 122 of the toy ring 110. Each one of the movable platforms 115 is operatively coupled to a respective launching post 114' such that as the launching post is moved from its first position to its second position the moveable platform 115 is moved from a first position to a second position.

Furthermore, each movable platform is configured to receive and support an action figure or action figurine 121 via a pair of features or bindings 117, 119 that are configured to releasably engage a foot portion 113 of the action figure or action figurine 121. In some embodiments, the features or bindings 117 have a base or base portion 191 with a forefoot strap portion 193 and a heel portion 195. The forefoot strap portion 193 is configured to receive and retain a forward portion of the foot portion 113 of the action figure or action figurine 121 while the heel portion 195 is configured to receive and retain a heel portion of the foot portion 113 of the action figure or action figurine 121 when the action figure or action figurine 121 is secured thereto. In some embodiments, the heel portion 195 is movably or slidably secured to the base portion 191 such that a portion of the heel portion 195 is slidably received within the base portion 191 for movement between a first position (illustrated at least in FIG. 8C) in the direction of arrow 197 to a second position (illustrated at least in FIG. 8D). Furthermore and in some embodiments, the heel portion 195 is spring biased into the first position by a spring 199 such that a biasing force in a direction opposite to that of arrow 197 is provided to heel portion 195 by spring 199.

Each feature or binding 117, 119 is movably secured to movable platform 115 via a post member 123, 125 that extends through movable platform 115 and extends away from a bottom surface 127 of the movable platform 115. As illustrated at least in FIGS. 8A and 8B one of the pair of features or bindings 117 is rotatably mounted to the movable platform 115 for pivotal movement in the direction of arrows 129 while the other one of the pair of features or bindings 119 is rotatably and slidably mounted to the movable platform 115.

Accordingly, the feature or binding 119 is able to slide along the movable platform 115 as the movable platform 115 moves from its first position to its second position. This is facilitated by a slotted opening 131 in the movable platform 115 which allows post member 125 to slide within the slotted opening 131 as the movable platform moves between its first position and its second position.

In addition, the feature or binding 117 is spring biased into a first position or first rotational position with respect to movable platform 115 by a spring 133 that engages the feature or binding 117 at one end and a portion of the movable platform at another end. The spring 133 engages a protrusion 135 that is configured to slide within a slotted opening 137 of movable platform 115 as the feature or binding 117 moves in the direction of arrows 129 with respect to movable platform 115.

In some embodiments and in order to provide a limit of rotational movement of the bindings or features 117 and 119 with respect to the moveable platform 115, a pair of stop features 201, 203 are provided, wherein stop feature 201 is configured and positioned to limit rotational movement of the binding 119 with respect to the moveable platform 115 while stop feature 203 is configured and positioned to limit rotational movement of the binding 117 with respect to the moveable platform 115.

Post member 123 is configured to be rotationally and removably secured (e.g., snap fit) into an opening 139 located on a surface or platform 122. Post member 125 is configured to be rotationally and removably secured (e.g., snap fit) into an opening 141 of a hub 143 located below the surface or platform 122. Hub 143 is rotatably mounted to an arm member 145 pivotally mounted to a linkage member 147 that is slidably received within a channel 149 along a bottom surface 151 of the platform 122. Arm member 145 is also pivotally mounted to the bottom surface 151 via a pin 153 for rotation about an axis defined by pin 153.

The linkage member 147 is operatively coupled to launching post 114' such that as the launching post 114' is pivoted or moved from its first position to its second position the linkage member 147 moves in the direction of arrow 155 within channel 149. This movement of linkage member 147 causes a post member 157 of linkage member 147 to move within a slotted opening 159 of arm member 145 while post 125 secured to rotatably mounted hub 143 slides within a slotted opening 161 of platform 122 as well as a slotted opening 164 of arm member 145.

As launching post 114' is moved from its first position to its second position the arm member 145 rotates from a first position (FIGS. 7A, 9A, 11A, 12A) to a second position (FIGS. 7B, 9B, 11B, 12B) in the direction of arrow 163. This is due to linkage member 147 sliding in the direction of arrow 155 along channel 149 while post 157 slides within opening 159 causing arm member 145 to pivot about post 153 in the direction of arrow 163 and post 125 slides within opening 161.

In addition and as illustrated in FIGS. 7A, 7B, 9A, 9B, 12A and 12B as the launching post 114' is moved from its first position to its second position, the movable platform 115 pivots about post 123 in the direction of arrow 165 while feature or binding 119 slides closer to feature or binding 117 due to post 125 sliding within opening 131 via its securement to hub 143 which moves as arm member 145 moves.

Accordingly and as the launching post 114' is moved from its first position to its second position the movable platform 115 rotates about post 123 in the direction of arrow 165, which is towards the other movable platform 115. Simultaneously binding or feature 119 slides towards binding or feature 117.

Figure 10:
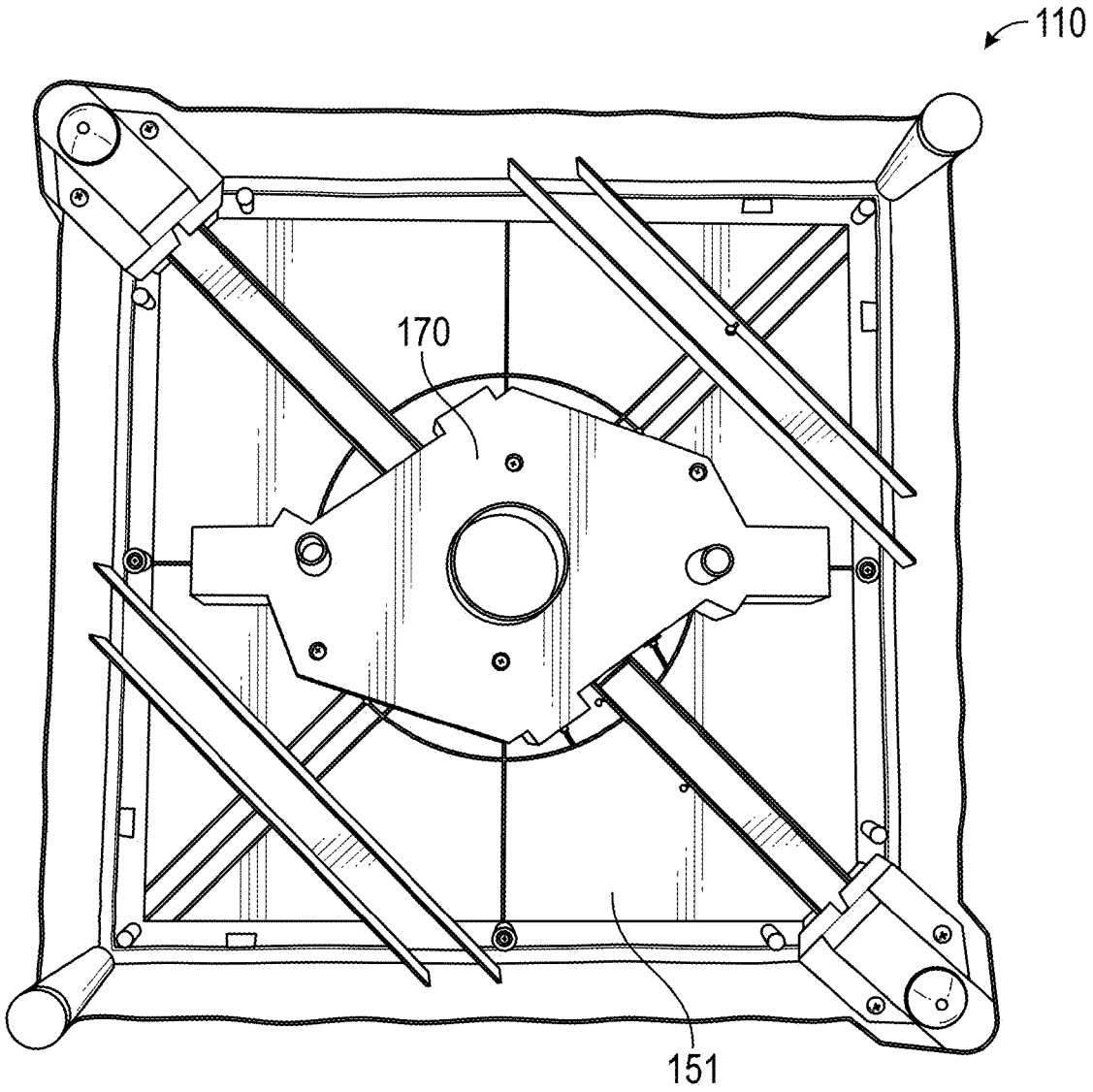
FIG. 10 is a bottom view of the toy.
Figure 11A:
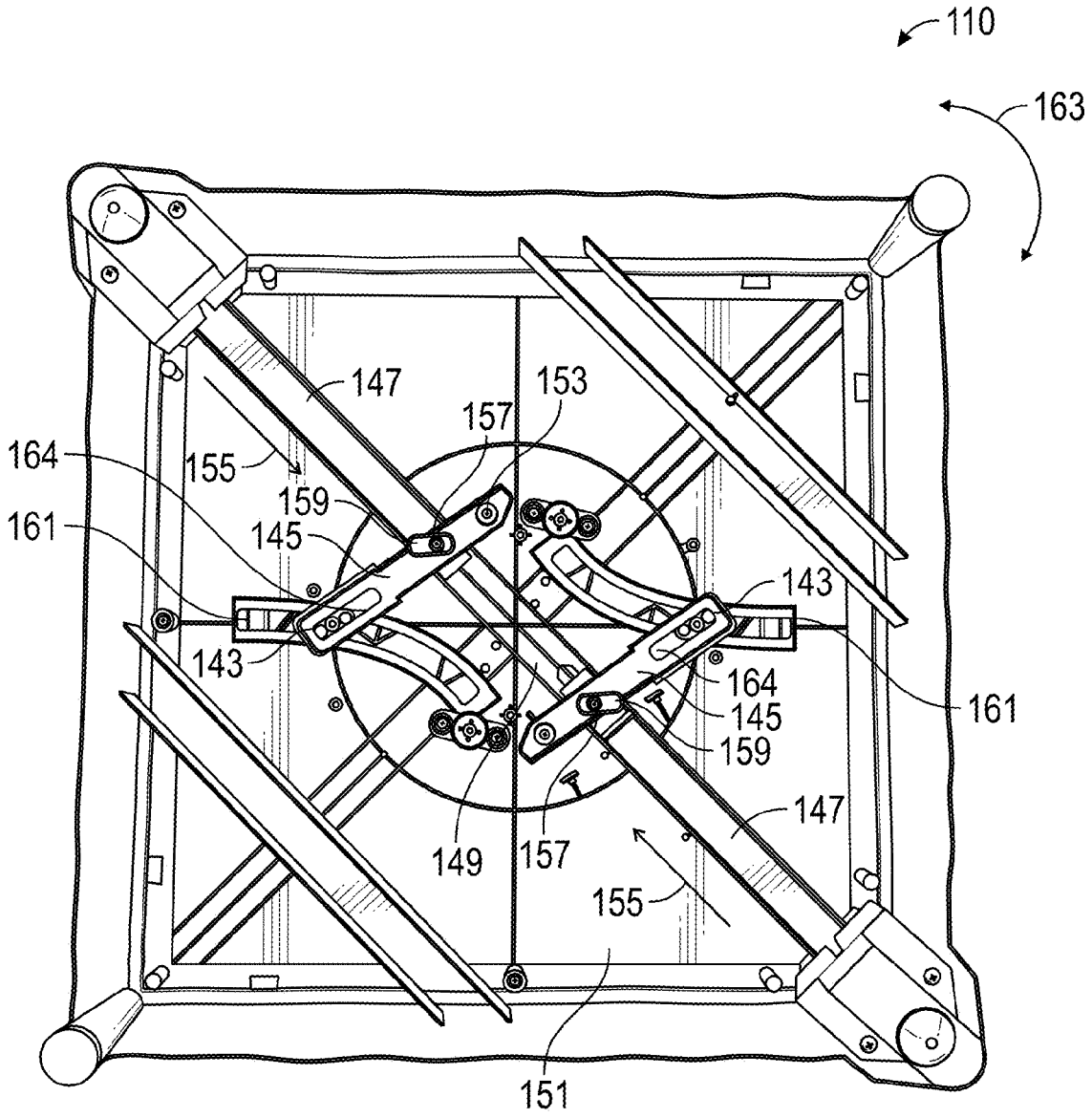
FIG. 11A is a bottom view of the toy in the first position with a housing portion removed.
Figure 11B:
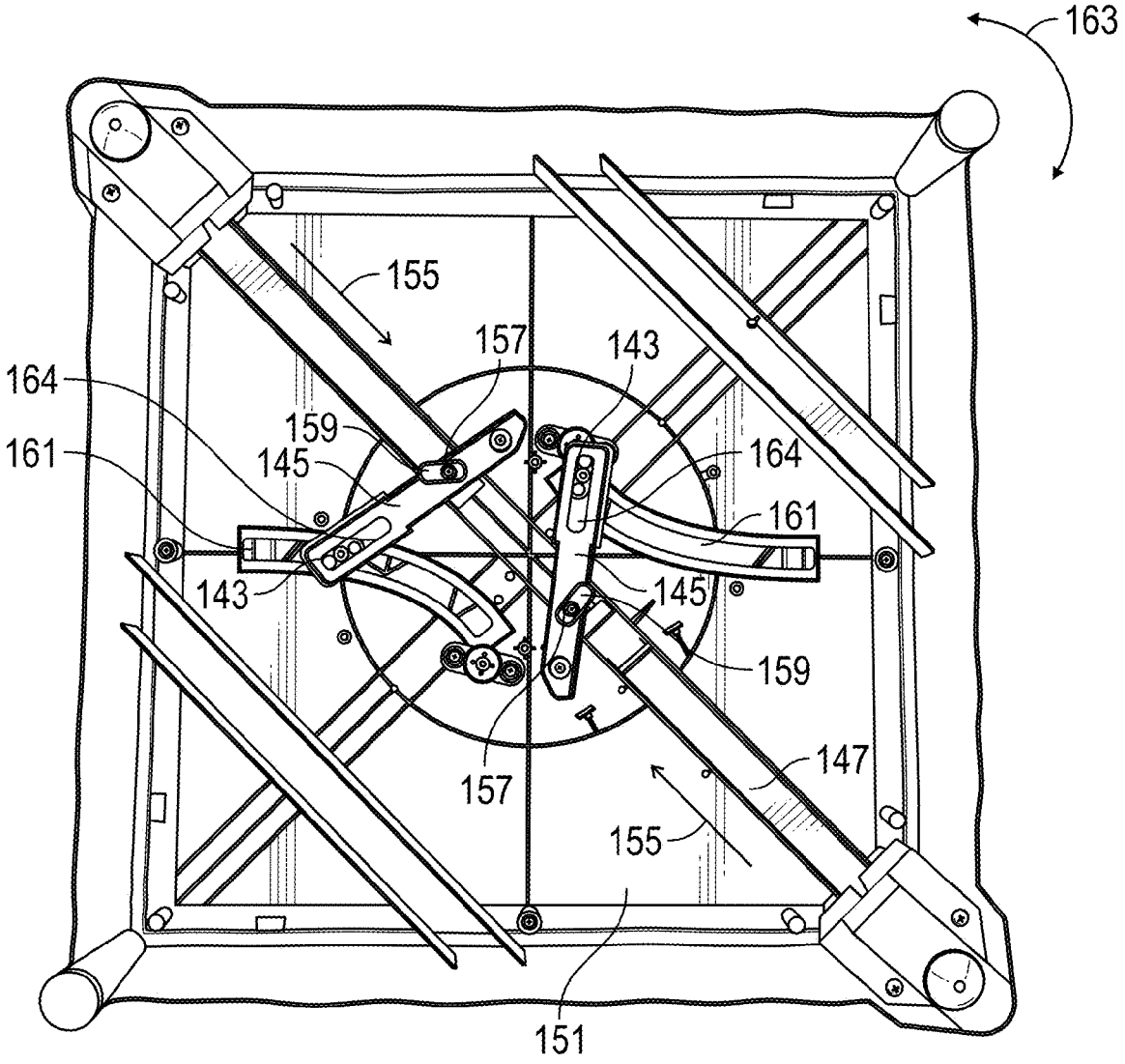
FIG. 11B is a bottom view of the toy in the second position with the housing portion removed.

FIG. 10 illustrates the bottom of the toy 110 with a cover portion 170 secured thereto. Cover portion 170 is configured to house at least arm members 145 in order to allow for unimpeded movement of the arm members 145 as the launching posts 114' are moved between their first and second positions.

Figure 12A:
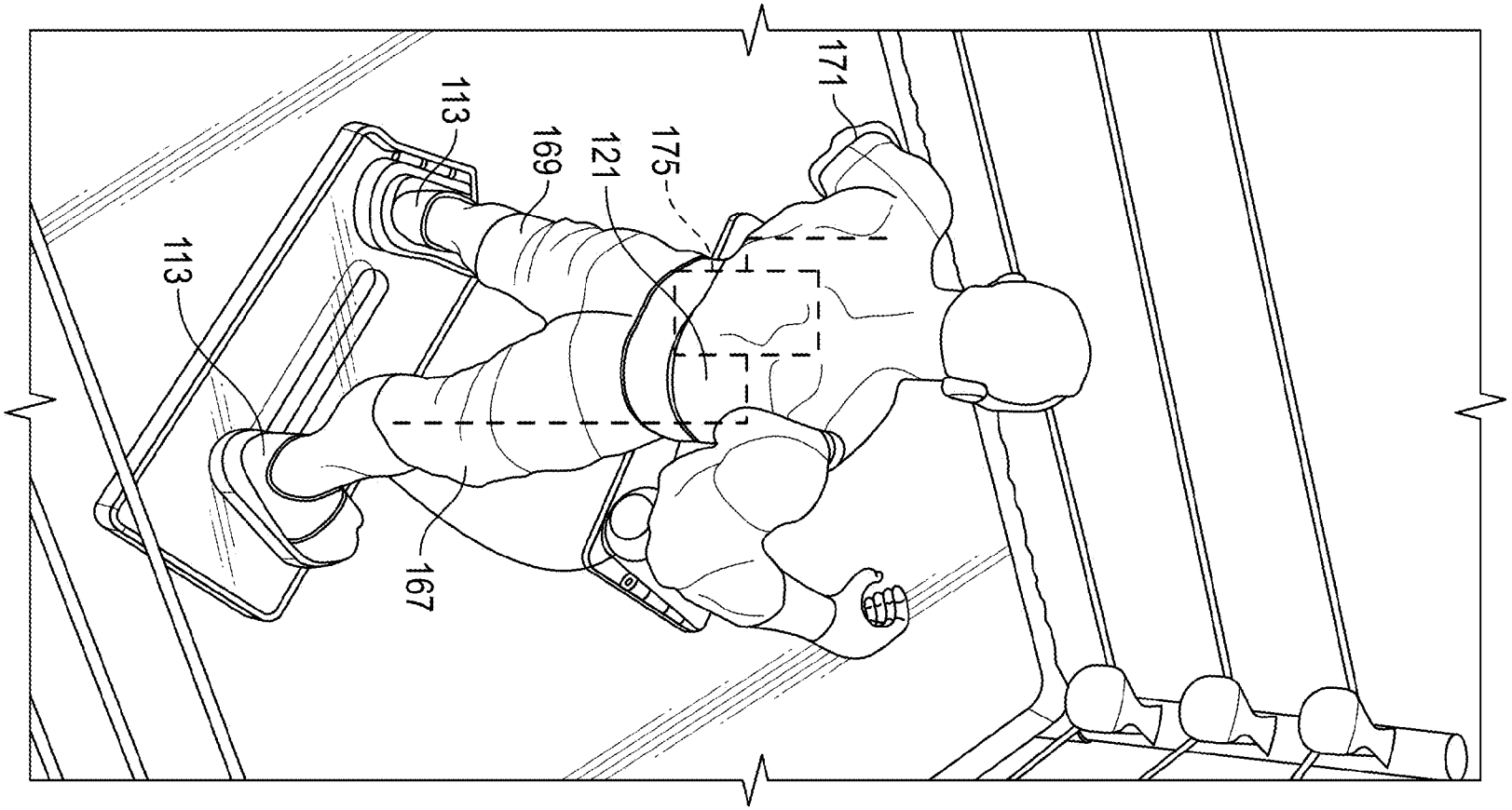
FIG. 12A is a perspective view of an action figure located on the moveable platform when the toy is in a first position.
Figure 12B:
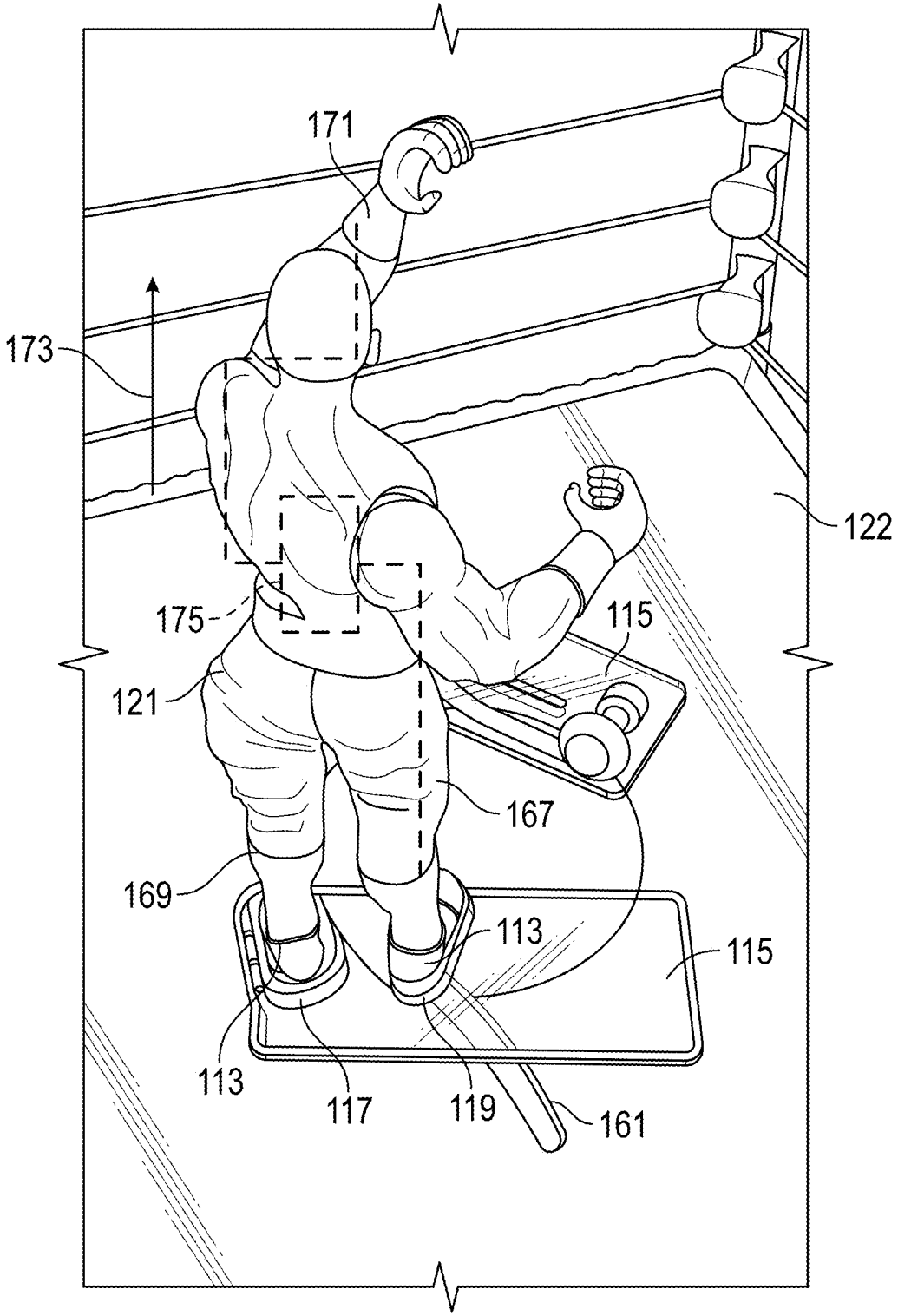
FIG. 12B is a perspective view of an action figure located on the moveable platform when the toy is in a second position.

Referring now to FIGS. 12A and 12B and as the movable platform 115 moves from its first position to its second position, a first leg 167 of the action figure or action figurine 121 secured to binding or feature 119 is moved towards a second leg 169 secured to binding or feature 117. This movement causes an arm member or appendage 171 to move from a first position (FIG. 12A) to a second position (FIG. 12B) in the direction of arrow 173. This is caused by arm member 171 being operatively coupled to the first leg 167 via an internal mechanism 175 configured to transfer the movement or force applied to first leg 167 (e.g., movement of first leg 167 towards second leg 169) to arm member 171 in order to transition the arm member 171 from its first position to its second position. In one embodiment, the movement of the arm member 171 from its first position to its second position may resemble a punching action.

In some embodiments, the action figure or figurine 121 may be of the type of commercially available under MATTEL's SUPER STRIKER trademark. In other embodiments, the action figure or figurine 121 may be similar to those disclosed in U.S. Patent Application Publication 2013/0084772 A1.

It being understood that FIGS. 7A, 9A, 11A, 12A and FIGS. 7B, 9B, 11B, 12B only illustrate the movement of one of the launching posts 114' and its associated movable platform 115 while various embodiments of the present invention contemplate that two or more launching post 114' can be moved from their first position to their second position in order to independently move their respective movable platforms 115 operably coupled thereto.

Figure 13:
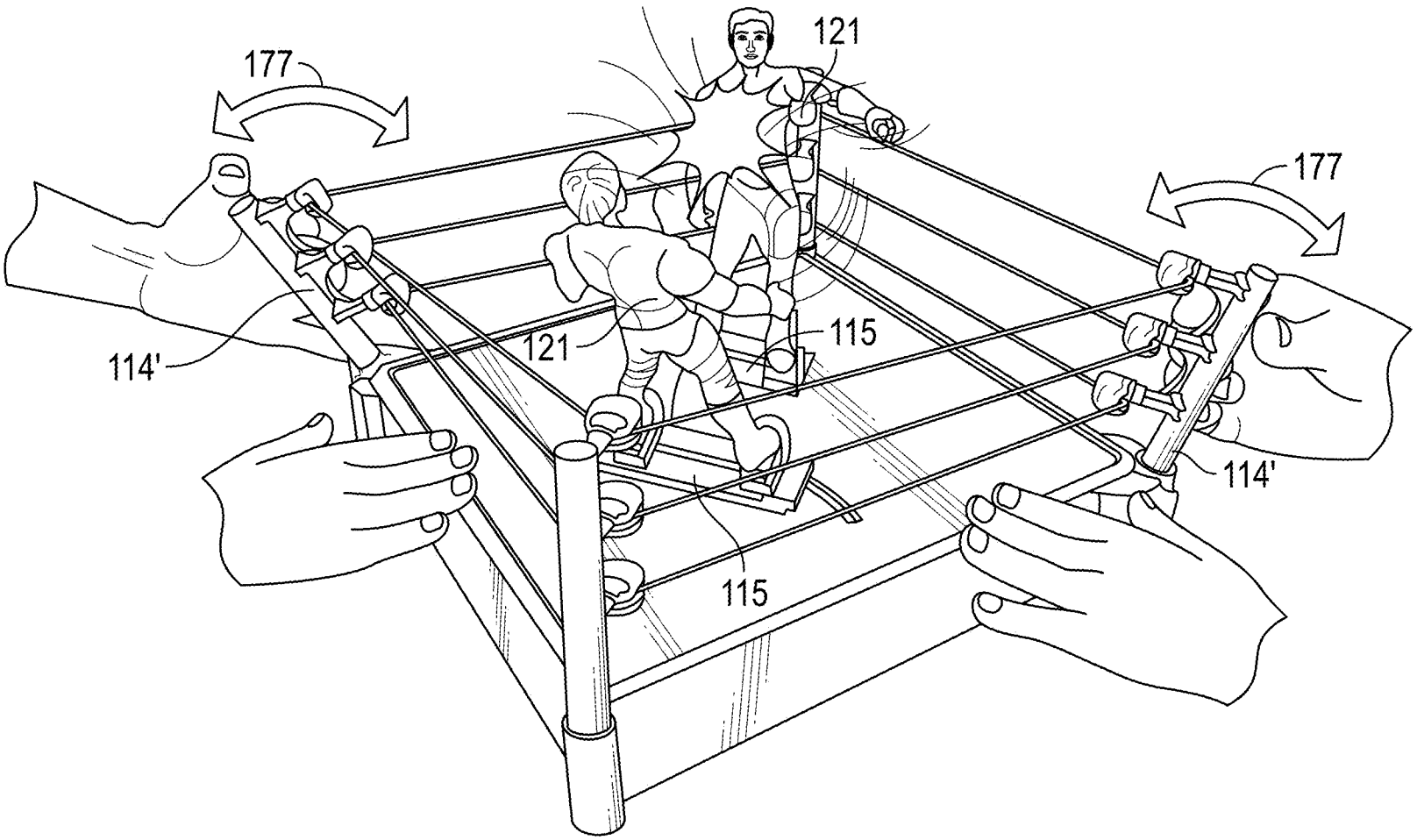
FIG. 13 is a perspective view of the toy illustrating one type of play pattern.

For example and as illustrated in FIG. 13, each launching post 114' can be moved between its respective first and second positions via pivotal movement in the direction of arrows 177 such that the associated movable platforms 115 and action figures or figurines 121 can move towards and away from each other with a punching motion illustrated in at least FIGS. 12A and 12B.

Figures 14A, 14B:
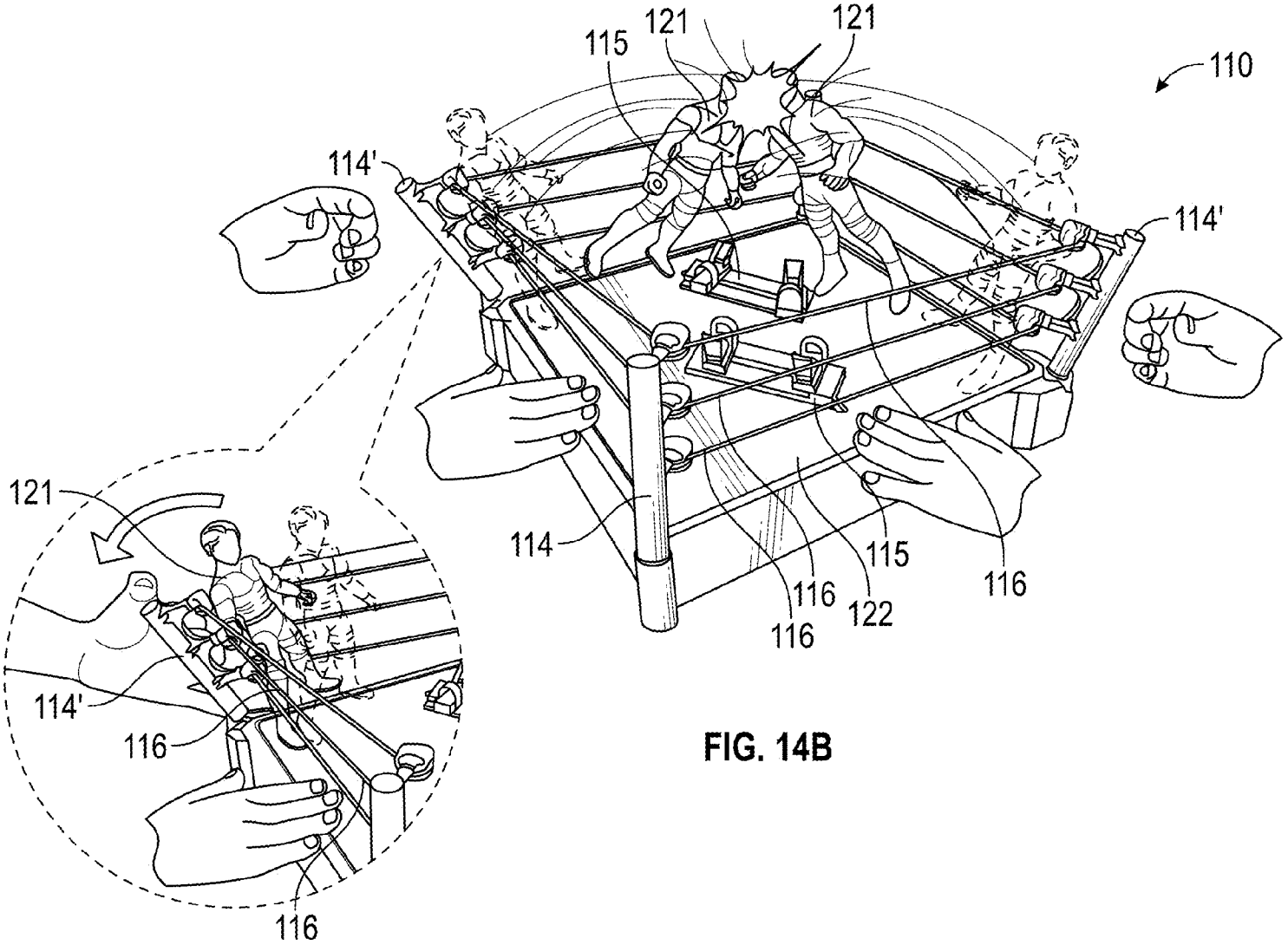
FIG. 14A and FIG. 14B are views illustrating another type of play pattern of the toy.

Alternatively and as illustrated in FIGS. 14A and 14B, each launching post 114' can be used to launch an action figure or figurine 121 towards each other.

As mention above, the play set or toy 110 is configured to have four posts 114 located about the perimeter of the play set or toy ring 110. Each post 114 includes a plurality of turnbuckles 118 that are coupled to one or more elastic bands or elastic members that are positioned as elastically expandable ropes 116 that form a perimeter of the play set 110. As mentioned above, at least one post 114' (e.g. the launching post) is selectively movable with respect to the play set and, in some embodiments, may be pivotally or movably secured to the play set 110 in order to allow for this movement.

As mentioned above, the launching post is spring biased into the first position such that application of a force to the launching post in order to move it towards the second position creates a biasing force towards the first position. Once the force for moving the launching post toward the second position is released, the launching post moves back towards the first position and can be used to cause action figure or figurine 121 to perform various functions.

As used herein, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. In addition, it is noted that the terms "bottom" and "top" are used herein, unless otherwise noted, merely for convenience of description, and are not limited to any one position or spatial orientation.

In the preceding detailed description, numerous specific details are set forth in order to provide a thorough understanding of various embodiments of the present invention. However, those skilled in the art will understand that embodiments of the present invention may be practiced without these specific details, that the present invention is not limited to the depicted embodiments, and that the present invention may be practiced in a variety of alternative embodiments. Moreover, repeated usage of the phrase "in an embodiment" does not necessarily refer to the same embodiment, although it may. Lastly, the terms "comprising," "including," "having," and the like, as used in the present application, are intended to be synonymous unless otherwise indicated.

This written description uses examples to disclose the invention, including the best mode, and to enable any person skilled in the art to practice the invention, including making and using any devices or systems. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A toy ring, comprising:

a platform;

a plurality of posts positioned about the platform, a first one of the plurality of posts being pivotally mounted to the platform at a first end and configured for movement between a first position and a second position, wherein a second end of the first one of the plurality of posts, opposite the first end, moves in a first direction away from the platform when the first one of the plurality of posts is moved from the first position to the second position;

an elastic member secured to each one of the plurality of posts, wherein the elastic member provides a biasing force to the first one of the plurality of posts in a second direction opposite to the first direction when the first one of the plurality of posts is in the second position; and a movable platform pivotally secured to the platform, wherein the movable platform moves from a first position to a second position as the first one of the plurality of posts is moved from its first position towards its second position.

2. The toy ring as in claim 1, wherein the movable platform is configured to removably support an action figurine.

3. The toy ring as in claim 1, wherein the movable platform further comprises a pair of bindings moveably movably secured thereto, the pair of bindings being configured to removably receive and retain a foot portion of an action figurine.

4. The toy ring as in claim 3, wherein one of the pair of bindings is rotationally secured to the movable platform and the platform while the other one of the pair of bindings is rotationally and slidably secured to the movable platform and the platform and wherein each one of the pair of bindings has a forefoot strap portion and a heel portion.

5. The toy ring as in claim 1, wherein the movable platform further comprises a pair of bindings movably secured thereto, the pair of bindings being configured to removably receive and retain a foot portion of an action figurine and wherein one of the pair of bindings moves towards the other one of the pair of bindings when the movable platform is moved from its first position to its second position.

6. The toy ring as in claim 5, wherein a first leg of the action figurine is moved towards a second leg of the action figurine when the movable platform is moved from its first position to its second position and the action figurine is secured thereto.

7. The toy ring as in claim 6, wherein movement of the first leg of the action figurine towards the second leg of the action figurine causes an arm member of the action figurine to move from a first position towards a second position.

8. The toy ring as in claim 1, wherein a second one of the plurality of posts is pivotally mounted to the platform at a first end and configured for movement between a first position and a second position, wherein a second end of the second one of the plurality of posts, opposite the first end, moves in a first direction away from the platform when the second one of the plurality of posts is moved from the first position to the second position;

wherein the elastic member provides a biasing force to the second one of the plurality of posts in a second direction opposite to the first direction when the second one of the plurality of posts is in the second position; and wherein the toy ring further comprises another movable platform pivotally secured to the platform, wherein the another movable platform moves from a first position to a second position as the second one of the plurality of posts is moved from its first position towards its second position.

9. The toy ring as in claim 8, wherein the movable platform and the another movable platform each have a pair of bindings movably secured thereto, the pair of bindings being configured to removably receive and retain a foot portion of an action figurine and wherein one of the pair of bindings moves towards the other one of the pair of bindings when the movable platform is moved from its first position to its second position.

10. The toy ring as in claim 9, wherein a first leg of the action figurine is moved towards a second leg of the action figurine when either the movable platform or the another movable platform is moved from its first position to its second position and the action figurine is secured thereto.

11. The toy ring as in claim 10, wherein movement of the first leg of the action figurine towards the second leg of the action figurine causes an arm member of the action figurine to move from a first position towards a second position.

12. A toy play set, comprising:

a structure;

a post pivotally mounted to the structure at a first end and configured for movement between a first position and a second position with respect to the structure, wherein a second end of the post, opposite the first end, moves in a first direction away from the structure when the post is moved from the first position to the second position;

an elastic member secured to the post, wherein the elastic member provides a biasing force to the post in a second direction opposite to the first direction when the post is in the second position;

a movable platform pivotally secured to the structure, wherein the movable platform is operatively coupled to the post and wherein the movable platform moves from a first position to a second position when the post operatively coupled thereto is moved from its first position towards its second position; and wherein the movable platform is configured to removably support an action figurine and wherein movement of the movable platform from its first position to its second position moves a first leg of the action figurine towards a second leg of the action figurine when the action figurine is secured thereto and wherein movement of the first leg of the action figurine towards the second leg of the action figurine causes an arm member of the action figurine to move from a first position towards a second position.

13. The toy play set as in claim 12, wherein the movable platform further comprises a pair of bindings movably secured thereto, the pair of bindings being configured to removably receive and retain a foot portion of the action figurine.

14. The toy play set as in claim 13, wherein one of the pair of bindings is rotationally secured to the movable platform and the structure via a first pin while the other one of the pair of bindings is rotationally and slidably secured to the movable platform and the structure via a second pin, wherein the second pin is slidably received in a slot of the movable platform and a slot of the structure.

15. In combination a toy wrestling ring and at least one action figurine, wherein the toy wrestling ring comprises:

a platform;

a plurality of posts positioned about the platform, a first one of the plurality of posts being pivotally mounted to the platform at a first end and configured for movement between a first position and a second position, where a second end of the first one of the plurality of posts, opposite the first end, moves in a first direction away from the platform when the first one of the plurality of posts is moved from the first position to the second position;

an elastic member secured to each one of the plurality of posts, wherein the elastic member provides a biasing force to the first one of the plurality of posts in a second direction opposite to the first direction when the first one of the plurality of posts is in the second position; and an action figurine operatively coupled to the first one of the plurality of posts via a movable member pivotally secured to the platform, such that movement of the first one of the plurality of posts between the first position and the second position causes the action figurine to transition from a first position to a second position.

16. The combination as in claim 15, wherein the movable member further comprises a pair of bindings movably secured thereto, the pair of bindings being configured to removably receive and retain a foot portion of the action figurine.

17. The combination as in claim 16, wherein one of the pair of bindings is rotationally secured to the movable platform member and the platform via a first pin while the other one of the pair of bindings is rotationally and slidably secured to the movable platform member and the platform via a second pin.

18. The combination as in claim 15, wherein the movable member further comprises a pair of bindings movably thereto, the pair of bindings being configured to removably receive and retain a foot portion of the action figurine and wherein one of the pair of bindings moves towards the other one of the pair of bindings when the first one of the plurality of posts is moved from its first position to its second position.

19. The combination as in claim 18, wherein a first leg of the action figurine is moved towards a second leg of the action figurine when the first one of the plurality of posts is moved from its first position to its second position and the action figurine is secured to the movable member.

20. The combination as in claim 19, wherein movement of the first leg of the action figurine towards the second leg of the action figurine causes an arm member of the action figurine to move from a first position towards a second position.

* * * * *